US006724358B2

(12) United States Patent
Ban et al.

(10) Patent No.: US 6,724,358 B2
(45) Date of Patent: Apr. 20, 2004

(54) ACTIVE MATRIX TYPE DISPLAY APPARATUS AND METHOD FOR DRIVING THE SAME

(75) Inventors: Atsushi Ban, Nara (JP); Yoshihiro Okada, Kyoto (JP); Wataru Nakamura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 425 days.

(21) Appl. No.: 09/809,644

(22) Filed: Mar. 15, 2001

(65) Prior Publication Data

US 2002/0008685 A1 Jan. 24, 2002

(30) Foreign Application Priority Data

Mar. 15, 2000 (JP) ..... P2000-072649

(51) Int. Cl.[7] ..... G09G 3/36
(52) U.S. Cl. ..... 345/92; 345/87; 345/94
(58) Field of Search ..... 345/87, 88, 92, 345/94, 98, 100; 327/589; 349/38; 428/1.1

(56) References Cited

U.S. PATENT DOCUMENTS

| | | | | |
|---|---|---|---|---|
| 4,382,194 A | * | 5/1983 | Nakano et al. | 327/589 |
| 5,151,805 A | | 9/1992 | Takeda et al. | |
| 5,945,972 A | * | 8/1999 | Okumura et al. | 345/98 |
| 5,977,940 A | * | 11/1999 | Akiyama et al. | 345/94 |
| 5,990,855 A | * | 11/1999 | Kobayashi et al. | 345/88 |
| 6,083,574 A | * | 7/2000 | Asao et al. | 428/1.1 |
| 6,088,070 A | * | 7/2000 | Ohtani et al. | 349/38 |
| 6,115,018 A | | 9/2000 | Okumura et al. | 345/95 |
| 6,130,654 A | | 10/2000 | Hayashi et al. | |
| 6,331,844 B1 | * | 12/2001 | Okumura et al. | 345/87 |

FOREIGN PATENT DOCUMENTS

| | | |
|---|---|---|
| JP | A 64-82019 | 3/1989 |
| JP | A 4-288589 | 10/1992 |
| JP | 9-54299 | 2/1997 |
| JP | A 9-127917 | 5/1997 |
| JP | A 9-258169 | 10/1997 |
| JP | 10-161615 | 6/1998 |
| JP | 10-253942 | 9/1998 |
| JP | A 11-109921 | 4/1999 |
| JP | A 11-202285 | 7/1999 |
| JP | A 11-202286 | 7/1999 |

* cited by examiner

*Primary Examiner*—Amare Mengistu
*Assistant Examiner*—Prabodh M. Dharia
(74) *Attorney, Agent, or Firm*—David G. Conlin; Steven M. Jensen; Edwards & Angell, LLP

(57) ABSTRACT

Pseudo-impulse display for reducing after-images during display of moving images in an active matrix type display apparatus. Liquid crystal capacitors are formed at intersections of signal lines and scanning lines to display images. Auxiliary capacitors are provided for keeping a potential difference across the liquid crystal capacitors during display. One of the two electrodes of the auxiliary capacitors is connected to a switching element together with a pixel electrode. After the liquid crystal capacitor and the auxiliary capacitor have been charged with a video signal on the signal lines while the switching element is selectively put into the conducting state with the scanning lines, and after a predetermined time has passed, an auxiliary capacitor driver applies a signal to the other electrode of the auxiliary capacitor, such that the display luminance due to the liquid crystal capacitor is reduced.

22 Claims, 18 Drawing Sheets

ACTIVE MATRIX TYPE DISPLAY APPARATUS AND METHOD FOR DRIVING THE SAME

BACKGROUND OF THE INVENTION

1. Field of the Invention

The present invention relates to an active matrix type display apparatus that is suitable for active matrix type display of images, in particular moving images, using for example liquid crystals, and to a driving method for the same.

2. Description of the Related Art

Conventionally, cathode ray tubes (CRTs) and liquid crystal displays (LCDs) are used for television receivers and computer displays. In liquid crystal display devices for image display, a display pattern is formed on the image screen by selective driving of pixel electrodes arranged in a matrix. When a voltage is applied between a selected pixel electrode and the counter electrode in opposition thereto, then the liquid crystal disposed between the electrodes is optically modulated, which can be seen as a display pattern. As a method for driving the pixel electrodes, the active matrix type driving method is known, in which the individual pixel electrodes are arranged in a matrix, and the pixel electrodes are connected to corresponding switching elements and driven. Generally well known as switching elements for selectively driving the pixel electrodes are thin film transistors (TFTs), and switching elements with so-called MIM (metal/insulator/metal) structure.

Liquid crystal display apparatuses are not only used for the display of still images, but also for the display of moving images. However, the display of moving images poses the problem that pronounced after-images can be observed, and that moving features appear to be followed by a tail. A major reason for the problem of after-images is the slow response of the liquid crystals that are ordinarily used, which is several dozen milliseconds. To solve this problem, not only the development of liquid crystals with faster response has been advancing, but as shown in Japanese Unexamined Patent Publication JP-A 4-288589 (1992), efforts are made to compensate the problem of the slow response of the liquid crystal by anticipatorily emphasizing changes of the voltage applied to the pixel electrodes. Also Japanese Unexamined Patent Publication JP-A 9-258169 (1997) discloses the idea of improving the after-images by anticipatorily emphasizing changes of the voltage applied to the liquid crystal for the display of moving images.

However, in recent years, it has been shown that the problem of after-images is not only caused by the slow responsiveness of the liquid crystals, but also by an after-image effect in human eyesight. That is to say, ordinary liquid crystal display apparatuses use hold mode display elements, which hold the voltage information written into the pixel electrodes for one vertical scanning period that lasts until the next writing process in the pixel capacitor between the pixel electrode and the counter electrode in opposition to the pixel electrode, often leading to after-images in human eyesight. When new information is written into the pixels, the information of the old frame, which was written in the previous vertical scanning period, is perceived as an after-image by the human eye. In image display with CRTs, on the other hand, the information is displayed only in the moment when the electron beam hits the screen, and during the remaining period, black display is performed in which nothing is displayed, so that the human eye does not perceive an after-image. Consequently, to realize a high-speed moving image with a liquid crystal display apparatus, it is necessary to display the information only during a portion of each vertical scanning period and to perform black display in which nothing is displayed during the rest of the vertical scanning period, so as to approximate an impulse mode, as is done in the case of CRTs.

FIG. 17 illustrates one idea for improving the after-images of liquid crystals with a pseudo-impulse mode. When the liquid crystal display is performed by transmission-type liquid crystal display, then it is necessary to turn on a backlight. If the backlight is turned off during a portion of each cycle of the vertical scanning signal, a substantially black display is possible. Japanese Unexamined Patent Publication JP-A 64-82019 (1989) discloses the idea of dividing one frame period for driving the liquid crystal to display one image frame into one vertical period in which a scanning signal is applied successively to the plurality of scanning lines Y1, Y2, etc., a liquid crystal response period lasting until display is performed with the driven liquid crystal, and a backlight ON period, so that the backlight is only on for a portion of one frame period. Also Japanese Unexamined Patent Publications JP-A 11-202285 (1999) and JP-A 11-202286 (1999) disclose the idea of partially turning the backlight off.

FIG. 18 shows another idea for displaying a pseudo-impulse mode on a liquid crystal display apparatus. For example Japanese Unexamined Patent Publications JP-A 9-127917 (1997) and JP-A 11-109921 (1999) disclose dividing one frame period into a vertical period and a black writing period, writing the original image display video signal during the vertical period, and writing a black signal to the pixels during the black writing period.

Improving the responsiveness of the liquid crystal by compensation, anticipatorily emphasizing changes of the voltage applied to the pixel capacitors as disclosed in JP-A 4-288589 and JP-A 9-258169, does not improve the after-image effect of human eyesight. And when turning off the backlight to perform display in pseudo-impulse mode as shown in FIG. 17, in the conventional technology disclosed in JP-A 64-82019, the backlight is turned off simultaneously on the entire display screen. Therefore, it is necessary to turn on the backlight after the vertical period, in which signals are written into the pixels in all display regions, and after the liquid crystal response period that lasts until the liquid crystal of the pixels that are scanned and into which the signal is written last has responded sufficiently. This means, the scanning time allotted per scanning line has to be made shorter than in the ordinary case when the backlight is not turned off. For example, when the backlight is turned on for ⅓ of each frame period, and ⅓ of each frame period is taken for the response of the liquid crystal, then the scanning time allotted as one vertical period is only ⅓ of the scanning time in the ordinary case. This corresponds to a display with a driving frequency that is three times as high, which puts a considerable load on the wiring resistances, switching performance of the TFTs, driver performance and the structure of the backlight, leading to lower display quality and higher costs. Moreover, it has also been suggested to shorten the time for the response of the liquid crystal and increase the scanning time serving as the vertical period by sequentially turning a plurality of back lights on and off, as shown in JP-A 11-202285 and JP-A 11-202286. However, also in this conventional technology, the fact that the vertical period for scanning is shorter than before remains unchanged, and there is also the problem of increased costs for the backlight structure.

Also when a black signal is written into the pixels and display is performed in pseudo-impulse mode as shown in FIG. 18, it is necessary to allot a black signal writing time of about one half of each frame period, so that the actual driving frequency is increased, and the same problems occur as in the prior art, in which the backlight is turned off. As a countermeasure, it has been suggested to provide scanning lines and signal lines for the application of the black signal as shown in JP-A 9-127917, but this leads to problems regarding lower yield due to an increased number of lines, an increased number of drivers, and increased costs for the source driver. It has also been suggested to partition the display portion and perform black display and video display in alternation as shown in JP-A 11-109921, but this leads to increased costs because of a more complicated circuit system and a larger number of signal drivers.

SUMMARY OF THE INVENTION

It is an object of the invention to present an active matrix type display apparatus, in which a black signal can be written into the pixels and display can be carried out in pseudo-impulse mode, without increasing the number of lines and without increasing the driving frequency, as well as a method for driving the same.

In one aspect of the invention, an active matrix type display apparatus comprises:

a plurality of signal lines;

a plurality of scanning lines intersecting with the signal lines;

switching elements arranged at intersections of the signal lines and the scanning lines, the switching elements being selectively put into a conductive state for a predetermined period of time per vertical period in accordance with a scanning signal on the scanning lines;

pixel capacitors arranged at the intersections and driven by a video signal on the signal lines through the switching elements in the conducting state, an image being displayed depending on a charge state of the pixel capacitors;

auxiliary capacitors associated with respective pixel capacitors, one sides of the auxiliary capacitors being connected to the switching elements;

a plurality of auxiliary capacitor lines, the other sides of the auxiliary capacitors being connected to the auxiliary capacitor lines; and a driver for driving the auxiliary capacitor lines such that a display luminance is reduced for a predetermined period of time while the switching elements are in the non-conducting state in accordance with the scanning signal on the scanning lines.

In accordance with the invention, a plurality of signal lines intersects with a plurality of scanning lines, and switching elements are arranged at intersections of the signal lines and the scanning lines to form an active matrix. Pixel capacitors and auxiliary capacitors are formed at these intersections. One side of the auxiliary capacitor is connected to the switching element, and the other side thereof is connected to an auxiliary capacitor line. The switching elements are selectively put into a conductive state for a predetermined period of time per vertical period, in accordance with a scanning signal on the scanning lines. When the switching elements are in the conducting state, the pixel capacitors and the auxiliary capacitors are charged in accordance with the video signal on the signal lines, and an image is displayed in accordance with the charge state of the pixel capacitors. A driver drives the auxiliary capacitor lines (not through the switching elements) such that the display luminance of the pixel capacitors is reduced through the auxiliary capacitors for a predetermined period of time while the switching elements are in the non-conducting state in accordance with the scanning signal on the scanning lines. Thus, even when the pixel capacitors have been charged in accordance with the video signal on the signal lines and turned into an image display state, the display luminance is reduced by driving the pixel electrodes through the auxiliary capacitors with the driver, and a pseudo-impulse display can be carried out. Conventionally, auxiliary capacitors have been used to improve the image quality by supplementing the insufficient charge capacitance of the pixel capacitors alone, and as these auxiliary capacitors can be used to improve the after-image characteristics, the image quality of dynamic images can be improved without adding new signal lines to the active matrix, increasing the driving frequency or turning the backlight on and off or partitioning the backlight.

With this invention, pixel capacitors and auxiliary capacitors are arranged at the intersections of a plurality of signal lines and a plurality of scanning lines forming an active matrix, and images are displayed in accordance with the charge state of the pixel capacitors. A driver drives through the auxiliary capacitors the auxiliary capacitor lines, and thereby the charge state of the pixel capacitors, such that the display luminance is reduced, so that the after-image characteristics during display of moving images can be improved by pseudo-impulse display, using the auxiliary capacitors provided to reinforce the charge state of the pixel capacitors. The change of the charge state of the pixel electrodes is not accomplished through the switching elements, so that pseudo-impulse display can be carried out without increasing the driving frequency for the pixel capacitors or adding new functions, such as turning the backlight on and off, and an active matrix type display apparatus that is suitable for high speed display of moving images can be realized without involving major increases in cost or deterioration of the image quality.

In another aspect of the invention, an active matrix type display apparatus comprises:

a plurality of signal lines;

a plurality of scanning lines intersecting with the signal lines;

switching elements arranged at intersections of the signal lines and the scanning lines, the switching elements being selectively put into a conductive state for a predetermined period of time per vertical period in accordance with a scanning signal on the scanning lines;

pixel capacitors arranged at the intersections and driven by a video signal on the signal lines through the switching elements in the conducting state, an image being displayed depending on a charge state of the pixel capacitors;

auxiliary capacitors associated with respective pixel capacitors, one sides of the auxiliary capacitors being connected to the switching elements;

a plurality of auxiliary capacitor lines, the other sides of the auxiliary capacitors being connected to the auxiliary capacitor lines; and a driver for driving the auxiliary capacitor lines such that a signal of the same polarity as the video signal, having a predetermined amplitude is applied at least once per vertical period, while the switching elements are in the non-conducting state in accordance with the scanning signal on the scanning lines.

In accordance with this aspect of the invention, a plurality of signal lines intersect with a plurality of scanning lines, and switching elements arranged at these intersections to form an active matrix. Pixel capacitors and auxiliary capacitors are formed at the intersections. One ends of the auxiliary capacitors are connected to the switching elements, and the other end is connected to an auxiliary capacitor line. The switching elements are selectively put into a conductive state for a predetermined period of time per vertical period by applying a scanning signal to the scanning lines. When the switching elements are in the conducting state, the pixel capacitors and the auxiliary capacitors are charged in accordance with the video signal on the signal lines, and an image is displayed in accordance with the charge state of the pixel capacitors. A driver drives the auxiliary capacitor lines (not through the switching elements) such that a signal of the same polarity as the video signal, having a predetermined amplitude is applied at least once per vertical period through the auxiliary capacitors to the pixel capacitors while the switching elements are in the non-conducting state in accordance with the scanning signal on the scanning lines. Thus, even when the pixel capacitors have been charged in accordance with the video signal on the signal lines and turned into an image display state, the display luminance is reduced by driving the pixel capacitors through the auxiliary capacitors with the driver, and a pseudo-impulse display can be carried out. Conventionally, auxiliary capacitors have been used to improve the image quality by supplementing the insufficient charge capacitance of the pixel capacitors alone, and as these auxiliary capacitors can be used to improve the after-image characteristics, the image quality of dynamic images can be improved without adding new signal lines to the active matrix, increasing the pixel driving frequency, or turning the backlight on and off or partitioning the backlight.

With this aspect of the invention, pixel capacitors and auxiliary capacitors are arranged at the intersections of a plurality of signal lines and a plurality of scanning lines forming an active matrix, and images are displayed in accordance with the charge state of the pixel capacitors. A driver drives the auxiliary capacitor lines such that a signal of the same polarity as the video signal is applied at least once per vertical period, so that the after-image characteristics during display of moving images can be improved by pseudo-impulse display, using the auxiliary capacitors provided to reinforce the charge state of the pixel capacitors. The change of the charge state of the pixel capacitors is not accomplished through the switching elements, so that pseudo-impulse display can be carried out without increasing the driving frequency for the pixel capacitors or adding new functions, such as turning the backlight on and off, and an active matrix type display apparatus that is suitable for high speed display of moving images can be realized without involving major increases in cost or deterioration of the image quality.

In the invention it is preferable that with respect to the scanning lines which select the switching elements, the auxiliary capacitors are divided into groups of a plurality of auxiliary capacitors, the group being associated with a plurality of neighboring scanning lines, and that the driver collectively drives all auxiliary capacitor lines connected to a group of auxiliary capacitors.

In accordance with this aspect of the invention, driving for pseudo-impulse display with the pixel capacitors through the auxiliary capacitors can be performed collectively for a plurality of neighboring scanning lines, so that the number of drivers can be decreased, and costs can be reduced.

In the invention it is preferable that the auxiliary capacitor lines driven by the driver are formed in parallel to the scanning lines.

In accordance with this aspect of the invention, one side of the auxiliary capacitor is connected to the switching element to which the scanning signal on the scanning line is applied, and the other side is connected to the auxiliary capacitor line in parallel to the scanning line. In the pseudo-impulse display through the auxiliary capacitors, the driver changes the charge state of the pixel capacitors through the auxiliary capacitor lines, so that luminance can be reduced.

Moreover, with this aspect of the invention, the auxiliary capacitors can be driven through the auxiliary capacitor lines arranged in parallel to the scanning lines such that the display luminance is reduced.

In the invention it is preferable that an active matrix is formed such that the auxiliary capacitor lines connected to the other sides of the auxiliary capacitors driven by the switching elements to which the scanning signal is applied from the scanning lines also serve as the respectively adjacent scanning lines; and the driver carries out driving for the auxiliary capacitors and driving for scanning the switching elements connected to the adjacent scanning lines.

In accordance with this aspect of the invention, to the scanning lines of the active matrix are connected (i) the switching elements which charge the pixel capacitors and the auxiliary capacitors in accordance with the display signal on the signal lines, and (ii) that side of the auxiliary capacitors charged in accordance with the scanning signal on the adjacent scanning lines that is not connected to the switching element. The driver for driving the scanning lines selectively puts the switching elements into the conducting state and drives the charge state of the pixel capacitors and the auxiliary capacitors charged by the scanning signal charging the pixel capacitors and the auxiliary capacitors and the scanning signal on the adjacent scanning line such that the luminance is reduced through those pixel capacitors, which makes it possible to perform pseudo-impulse display in an active matrix made of scanning lines and signal lines.

With this aspect of the invention, (i) application of the scanning signal for charging the pixel capacitors and the auxiliary capacitors in accordance with the display signal on the signal line, by selectively putting the switching elements into the conducting state through the scanning lines, and (ii) changing the charge state of the pixel capacitors charged by the scanning signal on the adjacent scanning line such that the luminance is reduced through those auxiliary capacitors, can be performed at different times. Since the auxiliary capacitors can be driven with the adjacent scanning lines instead of through the switching elements, the configuration of the active matrix can be simplified, and the manufacturing costs can be reduced.

In the invention it is preferable that the pixel capacitors include a liquid crystal layer arranged between opposing electrodes, and display is performed in normally white display mode, such that display luminance is high when a voltage applied between the electrodes is low, and display luminance is low when the voltage applied between the electrodes is high.

With this aspect of the invention, a liquid crystal layer is disposed between opposing electrodes of the pixel capacitors, and image display is performed in normally white display mode, in which the display luminance is high when the voltage applied between the electrodes is low, and the display luminance is low when the voltage applied between the electrodes is high. Driving through the auxiliary capacitors such that the voltage across the liquid crystal layer is increased, it is possible to provide a black display period, and improve the after-image characteristics during the display of moving images by pseudo-impulse display.

In a further aspect of the invention, a method for driving an active matrix type display apparatus comprising a plurality of signal lines; a plurality of scanning lines intersecting with the signal lines; switching elements arranged at intersections of the signal lines and the scanning lines, the switching elements being selectively put into a conductive state for a predetermined period of time per vertical period in accordance with a scanning signal on the scanning lines; pixel capacitors arranged at the intersections and driven by a video signal on the signal lines through the switching elements in the conducting state, an image being displayed depending on a charge state of the pixel capacitors; auxiliary capacitors associated with respective pixel capacitors, one sides of the auxiliary capacitors being connected to the switching elements; and a plurality of auxiliary capacitor lines, the other sides of the auxiliary capacitors being connected to the auxiliary capacitor lines, the method comprising:

driving the auxiliary capacitor lines, for a predetermined period of the period in which the switching elements are in the non-conducting state in accordance with the scanning signal on the scanning lines, such that a charge state of the pixel capacitors connected to the switching elements changes to a display luminance reduction side.

In accordance with the invention, a plurality of signal lines intersects with a plurality of scanning lines in an active matrix type display device, and switching elements, pixel capacitors and auxiliary capacitors are formed at the intersections. One side of the auxiliary capacitor is connected to a switching element, and the other side is connected to an auxiliary capacitor line. The switching elements are selectively put into a conductive state for a predetermined period of time per vertical period with a scanning signal on the scanning lines, and the pixel capacitors and the auxiliary capacitors are charged with the video signal on the signal lines. Image display is carried out in accordance with the charge state of the pixel capacitors, and the auxiliary capacitors reinforce the charge state of the pixel capacitors. The auxiliary capacitor lines are driven (not through the switching elements) such that the charge state of the pixel capacitors is changed towards a reduction of the display luminance through the auxiliary capacitors for a predetermined period of time while the switching elements are in the non-conducting state in accordance with the scanning signal on the scanning lines, so that display with the pixel capacitors is performed for only a portion of each vertical period, and pseudo-impulse display can be performed. Conventionally, auxiliary capacitors have been used to achieve that the voltage between the electrodes at both sides of the auxiliary capacitor in an active matrix type display apparatus substantially does not change during one vertical period. Using these auxiliary capacitors, pseudo-impulse driving can be carried out, including in each vertical period a period for partially reducing the display luminance, so that the capability of displaying moving images can be improved by pseudo-impulse driving without necessitating a display period for luminance reduction that shortens the scanning period during each vertical period, without controlling the backlight, and substantially not changing the configuration of a conventional active matrix type display apparatus.

With this aspect of the invention, a plurality of signal lines intersects with a plurality of scanning lines. Pixel electrodes that are arranged in matrix shape at these intersections are selectively charged with display signals on signal lines through switching elements provided at the intersections, the switching elements being selected by scanning signals on scanning lines. When image display is performed, the auxiliary capacitor lines connected to the auxiliary capacitors used to reinforce the holding of the display voltage by the pixel electrodes are used to provide a period in which the display luminance is reduced and to perform pseudo-impulse display, so that the after-image characteristics can be improved. The high speed display of moving images can be improved by pseudo-impulse display, without adding major changes to the configuration of the active matrix type display apparatus, which uses auxiliary capacitors to reinforce the pixel capacitors, and without an increase of the driving frequency for driving the switching elements, as would be necessary when shortening the overall scanning time. Also, there is no need to turn the backlight on and off for impulse display, or to partition it, so that the image quality for moving images can be improved without major increases in cost.

In a further aspect of the invention, a method for driving an active matrix type display apparatus comprising a plurality of signal lines; a plurality of scanning lines intersecting with the signal lines; switching elements arranged at intersections of the signal lines and the scanning lines, the switching elements being selectively put into a conductive state for a predetermined period of time per vertical period in accordance with a scanning signal on the scanning lines; pixel capacitors arranged at the intersections and driven by a video signal on the signal lines through the switching elements in the conducting state, an image being displayed depending on a charge state of the pixel capacitors; auxiliary capacitors associated with respective pixel capacitors, one sides of the auxiliary capacitors being connected to the switching elements; and a plurality of auxiliary capacitor lines, the other sides of the auxiliary capacitors being connected to the auxiliary capacitor lines, the method comprising:

driving the auxiliary capacitor lines, for a period of time in which the switching elements are in the non-conducting state in accordance with the scanning signal on the scanning lines, such that a signal of the same polarity as the video signal, having a predetermined amplitude is applied at least once per vertical period.

In accordance with this aspect of the invention, a plurality of signal lines intersects with a plurality of scanning lines in an active matrix type display apparatus, and switching elements, pixel capacitors and auxiliary capacitors are arranged at these intersections. One side of the auxiliary capacitor is connected to the switching element, and the other side is connected to an auxiliary capacitor line. The switching elements are selectively put into a conductive state for a predetermined period of time per vertical period by applying a scanning signal to the scanning lines, and the pixel capacitors and auxiliary capacitors are charged with the video signal on the signal lines. An image is displayed in accordance with the charge state of the pixel capacitors, and the auxiliary capacitors reinforce the charge state of the pixel capacitors. The auxiliary capacitor lines are driven for a period of time in which the switching elements are in the non-conducting state in accordance with the scanning signal on the scanning lines, such that a signal of the same polarity as the video signal and having a predetermined amplitude is applied so that the charge state of the pixel capacitors is changed toward lower display luminance, not through the switching elements but through the auxiliary capacitor lines.

Thus, display with the pixel capacitors is performed during a portion of each vertical period, and pseudo-impulse display can be accomplished. Conventionally, auxiliary capacitors have been used to achieve that the voltage between the electrodes at both sides of the auxiliary capacitors in an active matrix type display apparatus substantially does not change during one vertical period. Using these auxiliary capacitors, pseudo-impulse driving can be carried out, including in each vertical period a period for partially reducing the display luminance, so that the capability of displaying moving images can be improved by pseudo-impulse driving without necessitating a display period for luminance reduction that shortens the scanning period during each vertical period, without controlling the backlight, and substantially not changing the configuration of a conventional active matrix type display apparatus.

With this aspect of the invention, a plurality of signal lines intersects with a plurality of scanning lines. Pixel electrodes that are arranged in matrix shape at these intersections are selectively charged with display signals on signal lines through switching elements provided at the intersections, the switching elements being selected by scanning signals on scanning lines. When image display is performed, the auxiliary capacitor lines connected to the auxiliary capacitors used to reinforce the holding of the display voltage by the pixel electrodes are used to apply a signal of the same polarity as the video signal at least once per vertical period, thereby performing pseudo-impulse display and improving the after-image characteristics. Thus, the high speed display of moving images can be improved by pseudo-impulse display, without adding major changes to the configuration of the active matrix type display apparatus, which uses auxiliary capacitors to reinforce the pixel capacitors, and without an increase of the driving frequency for driving the switching elements, as would be necessary when shortening the overall scanning time. Also, there is no need to turn the backlight on and off for impulse display, or to partition it, so that the image quality for moving images can be improved without major increases in cost.

In the invention it is preferable that the pixel capacitors include a liquid crystal layer arranged between opposing electrodes, and display is performed in normally white display mode, such that the display luminance is high when the voltage applied between the electrodes is low, and the display luminance is low when the voltage applied between the electrodes is high.

In accordance with this aspect of the invention, a liquid crystal layer is disposed between opposing electrodes of the pixel capacitors, and image display is performed in normally white display mode, in which the display luminance is high when the voltage applied between the electrodes is low, and the display luminance is low when the voltage applied between the electrodes is high. Driving through the auxiliary capacitors such that the voltage across the liquid crystal layer is increased, it is possible to provide a black display period, and improve the after-image characteristics during the display of moving images by pseudo-impulse display.

Also, with this aspect of the invention, liquid crystal display is carried out in normally white display mode on an active matrix type display apparatus, and pseudo-impulse display is accomplished by providing a partial black display period during the scanning periods, so that the after-image characteristics during display of moving images can be improved.

In the invention it is preferable that the predetermined period of the period in which the switching elements are in the non-conducting state is within a range of 10% to 70% of the period in which the switching elements are selectively put into the conducting state in accordance with the scanning signal on the scanning lines.

In accordance with this aspect of the invention, driving to reduce the display luminance through the auxiliary capacitors is carried out for at least 10% and at most 70% of the period in which the switching elements are selectively put into the conducting state in accordance with the scanning signals on the scanning lines, so that pseudo-impulse display can be performed and the after-image characteristics during the display of moving images can be improved by partially reducing the display luminance, without a major decrease in display luminance or display contrast.

In the invention it is preferable that driving of the auxiliary capacitor lines is carried out such that an absolute value $|\Delta Vcs|$ of a total displacement potential $\Delta Vcs$ between the electrodes of the pixel capacitors which is produced through the auxiliary capacitors satisfies the condition $|\Delta Vcs| > Vc \times Cp/Ccs$, wherein Vc is an intermediate luminance display voltage applied to the pixel capacitors during display, Cp is a total capacitance of a pixel capacitor including a capacitance Ccs of the auxiliary capacitor.

In accordance with this aspect of the invention, due to the change of the charge state of the pixel capacitor through the auxiliary capacitor a change can be applied that is larger than the change of the intermediate luminance display voltage Vc, so that it is possible to improve the after-image characteristics during display of moving images without completely black display in the luminance reduction period.

Also, with this aspect of the invention, driving is performed such that a period is provided in which the luminance is reduced below the intermediate luminance through the auxiliary capacitor lines, so that the after-image characteristics when displaying moving images can be improved by pseudo-impulse display.

In the invention it is preferable that an overshooting voltage is applied at an initial stage when driving the auxiliary capacitor lines.

In accordance with this aspect of the invention, an overshooting voltage is applied at an initial stage of driving through the auxiliary capacitors to perform pseudo-impulse driving, so that reductions of the display luminance can be carried out quickly, and an advantageous pseudo-impulse driving can be carried out without reducing the period in which driving for display luminance reduction is performed.

Also, in this aspect of the present invention, an overshooting voltage is applied initially when driving the auxiliary capacitor lines, so that the display luminance can be reduced quickly, and the effect of after-images can be reduced drastically.

In the invention it is preferable that the voltage is changed stepwise when driving the auxiliary capacitor lines.

In accordance with this aspect of the invention, driving of the display luminance through the auxiliary capacitor lines is performed by changing the voltage stepwise, so that the load on the driver can be reduced, and it becomes easy to collectively drive the auxiliary capacitors, especially when forming groups of scanning lines.

Also, with this aspect of the invention, driving for reducing the display luminance through the auxiliary capacitor lines is performed by changing the voltage stepwise, so that the load on the driver controlling the voltage change through the auxiliary capacitors is reduced.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
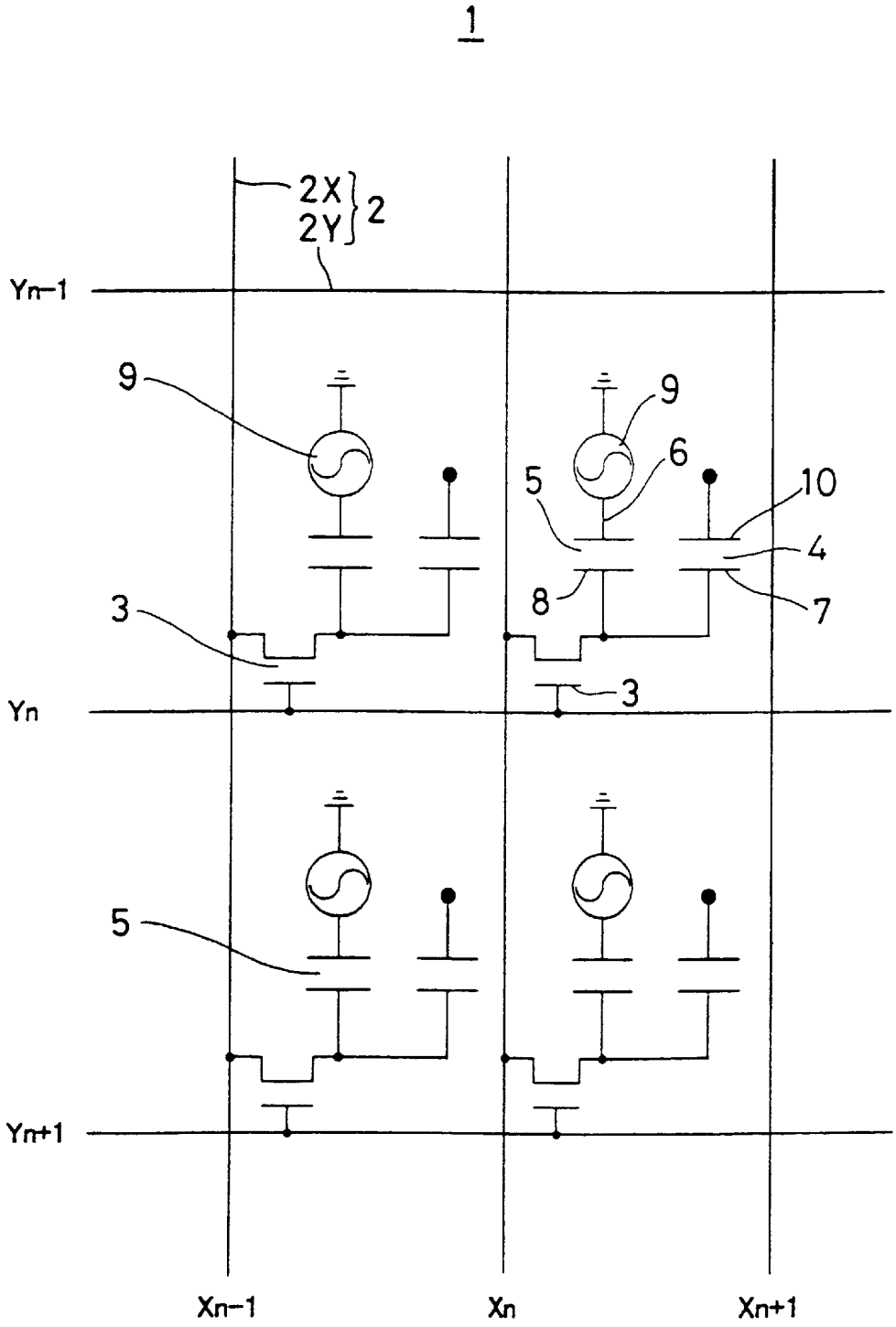
FIG. 1 is an equivalent circuit diagram of pixels of an active matrix type display apparatus 1 in accordance with an embodiment of the invention.

Now referring to the drawings, preferred embodiments of the invention are described below.

In the following embodiments, corresponding elements are marked by like numerals, and duplicate explanations have been omitted.

FIG. 1 shows a simplified equivalent circuit diagram of pixels of an active matrix type display apparatus 1 in accordance with an embodiment of the invention. An active matrix 2 of the active matrix type display apparatus 1 is provided by arranging a plurality of signal lines 2X and a plurality of scanning lines 2Y in matrix form, and forming TFTs serving as switching elements 3 at the intersections. The switching elements 3 are connected to liquid crystal capacitors 4 serving as the pixel capacitors and auxiliary capacitors 5, arranged in the vicinity of the operating portions. One of the two sides of the auxiliary capacitor 5 is connected to the switching element 3, and the other one is connected to an auxiliary capacitor line 6.

To the drain electrode of the TFTs serving as the switching elements 3 of the active matrix 2 are connected a pixel electrode 7 of the liquid crystal capacitor 4 and an auxiliary capacitor electrode 8 on one side of the auxiliary capacitor 5. The auxiliary capacitor line 6 is connected to that electrode of the auxiliary capacitor 5, that is not the auxiliary capacitor electrode 8, and the auxiliary capacitor line 6 is driven by an auxiliary capacitor driver 9. Of the two electrodes of the liquid crystal capacitor 4, the electrode that is not the pixel electrode 7 is connected electrically to an counter electrode 10. A liquid crystal is filled between the pixel electrode 7 and the counter electrode 10, and the optical properties of the liquid crystal are changed depending on the voltage applied between the pixel electrode 7 and the counter electrode 10, so as to perform image display. Well-known methods for image display using liquid crystals include TN (twisted nematic) mode, transverse field mode known as IPS (in-plane switching) mode, and VA (vertical alignment) mode. In TN mode and VA mode, the pixel electrodes 7 and the counter electrodes 10 are formed on respective opposing glass substrates. In IPS mode, both the pixel electrodes 7 and the counter electrodes 10 are formed on one of the opposing glass substrates. The invention can be applied not only to the TN mode and the VA mode, in which an electric field is applied in vertical direction with respect to the liquid crystal sealed between the glass substrates, but also to the IPS mode, in which the electric field is applied in lateral direction with respect to the liquid crystal.

The scanning lines 2Y selectively drive the gate electrodes of the TFT switching elements 3, whose drain electrodes are connected to the liquid crystal capacitors 4 arranged in horizontal scanning direction, such that once per vertical scanning period the gate electrodes are put into the conducting state. At each horizontal scanning cycle, the scanning line 2Y whose switching elements 3 are put in the conducting state sequentially moves to the neighboring scanning line. In the horizontal scanning cycles, the switching elements 3 are in the conducting state for a predetermined period of time. The signal lines 2X are connected to the source electrodes of the TFT switching elements 3, and a signal voltage is applied to the signal lines 2X. The scanning lines 2Y intersecting with the signal lines 2X, are conducting while moving sequentially at each horizontal cycle, so that the liquid crystal capacitors 4 can be charged with the signal voltage over the signal lines 2X, while the scanning signal applied to the scanning line selects a number of liquid crystal capacitors 4 arranged in horizontal scanning directions. In the same manner, it is also possible to charge the auxiliary capacitors 5.

In conventional active matrix type liquid crystal display apparatuses, the auxiliary capacitors are provided such that, once the switching elements have been selected with the scanning lines and put into the conducting state to charge the pixel capacitors, the potential of the charged pixel capacitors does not change until the switching elements are made conductive again with the next scanning signal after one vertical scanning period to charge the pixel electrodes with the next display signal. In the active matrix type display apparatus 1 of this embodiment, however, when the switching elements 3 are put into the non-conducting state with the scanning signal of the scanning line 2Y, a signal Cs with an amplitude ΔVcs is applied from the auxiliary capacitor driver 9 through the auxiliary capacitors 5 after holding the display signal for a predetermined period of time that is shorter than one vertical scanning period. When Clc is the capacitance of the liquid crystal capacitor 4 and Ccs is the capacitance of the auxiliary capacitor 5, then the voltage between the pixel electrode 7 and the counter electrode 10 of the liquid crystal capacitor 4 changes by $\Delta Vclc=\Delta Vcs\times Ccs/(Ccs+Clc)$. Determining ΔVcs such that the display luminance becomes lower than with the display signal voltage applied when the switching elements 3 are in the conducting state, it is possible to perform driving for pseudo-impulse display.

Figure 2:
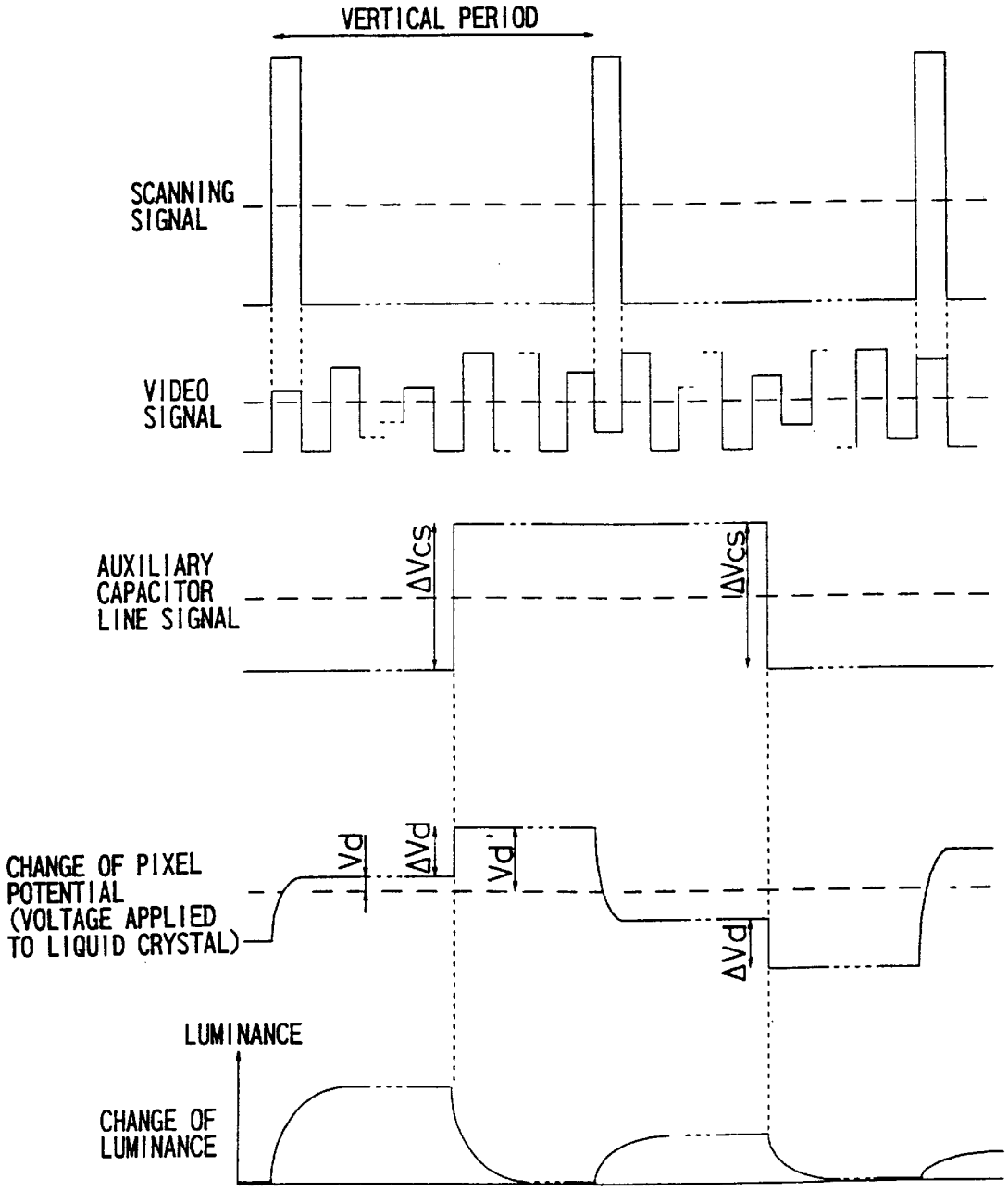
FIG. 2 is a drive timing chart for the active matrix type display apparatus 1 in FIG. 1.

FIG. 2 illustrates the drive timing for image display with the liquid crystal capacitors 4 in normally white display mode in the active matrix type display apparatus 1 shown in FIG. 1. Assuming that n-channel TFT elements are used for the switching elements 3, the necessary pulse for turning the switching elements 3 on (conducting state) is applied as the scanning signal at each vertical cycle. The width of this scanning pulse is equal to or less than the time given by one vertical period divided by the number of scanning lines 2Y. By sequentially applying the scanning pulse to one scanning line at a time, the scanning pulse is applied to all scanning lines 2Y over one vertical period. A video signal is applied to the liquid crystal such that the potential difference between the signals applied to the counter electrodes 10 takes on opposite polarity at each scanning line. It is also applied so that the polarity reverses at each vertical period. This is done to perform ac driving to avoid deterioration of the liquid crystal layer between the liquid crystal capacitors 4. However, the polarity of this potential difference is determined by the relation between the pixel electrode 7 and the counter electrode 10, so that if the polarity is not inverted with the signal applied to the counter electrode 10, the video signal applied over the signal lines 2X can also be a signal of the same polarity instead of a signal with opposite polarity for each scanning line.

The ON pulse of the scanning signal writes the video signal applied to the signal lines 2X at this time into the pixel electrode 7 of the liquid crystal capacitor 4 and the auxiliary capacitor electrode 8 of the auxiliary capacitor 5. The voltage corresponding to this written signal is held even when the switching elements 3 have been put into the non-conducting state. After a video signal has been applied, and after a certain response time has passed, the liquid crystal between the pixel electrodes 7 and the counter electrodes 10 on both sides of the liquid crystal capacitor 4 is modulated to optical characteristics corresponding to the potential difference between the pixel electrodes 7 and the counter electrodes 10. Based on this modulation of the optical characteristics, a transmittance of the backlight, that is, a display luminance is attained that corresponds to the video signal. During that time, the signal Cs applied through the auxiliary capacitor line 6 is driven with the auxiliary capacitor driver 9 such that it is at a constant potential or one that varies together with the counter electrode 10 of the liquid crystal capacitor 4. That is to say, it is held so that the voltage applied to the liquid crystal capacitor 4 does not vary. In this embodiment, the potential of the counter electrode 10 is constant.

The signal Cs is applied to the auxiliary capacitor line 6 such that during the period in which the switching element 3 is in the non-conducting state following an ON pulse, after a predetermined time has passed, a change of potential of ΔVcs is generated. In this embodiment, a normally white display mode liquid crystal is used, so that a change of the same polarity as the potential of the video signal applied to the pixel electrode 7 is applied as ΔVcs. When Cp is the total pixel capacitance including the capacitance Clc of the liquid crystal capacitor 4 and the capacitance Ccs of the auxiliary capacitor 5, then the potential change of ΔVcs causes a potential change $\Delta Vd=\Delta Vcs\times Ccs/Cp$ at the pixel electrode 7. The pixel potential Vd indicating the potential of the pixel electrode 7 with respect to the potential of the counter electrode 10 changes with the potential difference ΔVd, giving $Vd'=Vd+\Delta Vd$. If ΔVcs, Clc, Ccs, Cp, etc. are selected such that the changing pixel potential Vd' corresponds to black display or almost black display, then pseudo-impulse display can be achieved.

Figure 3:
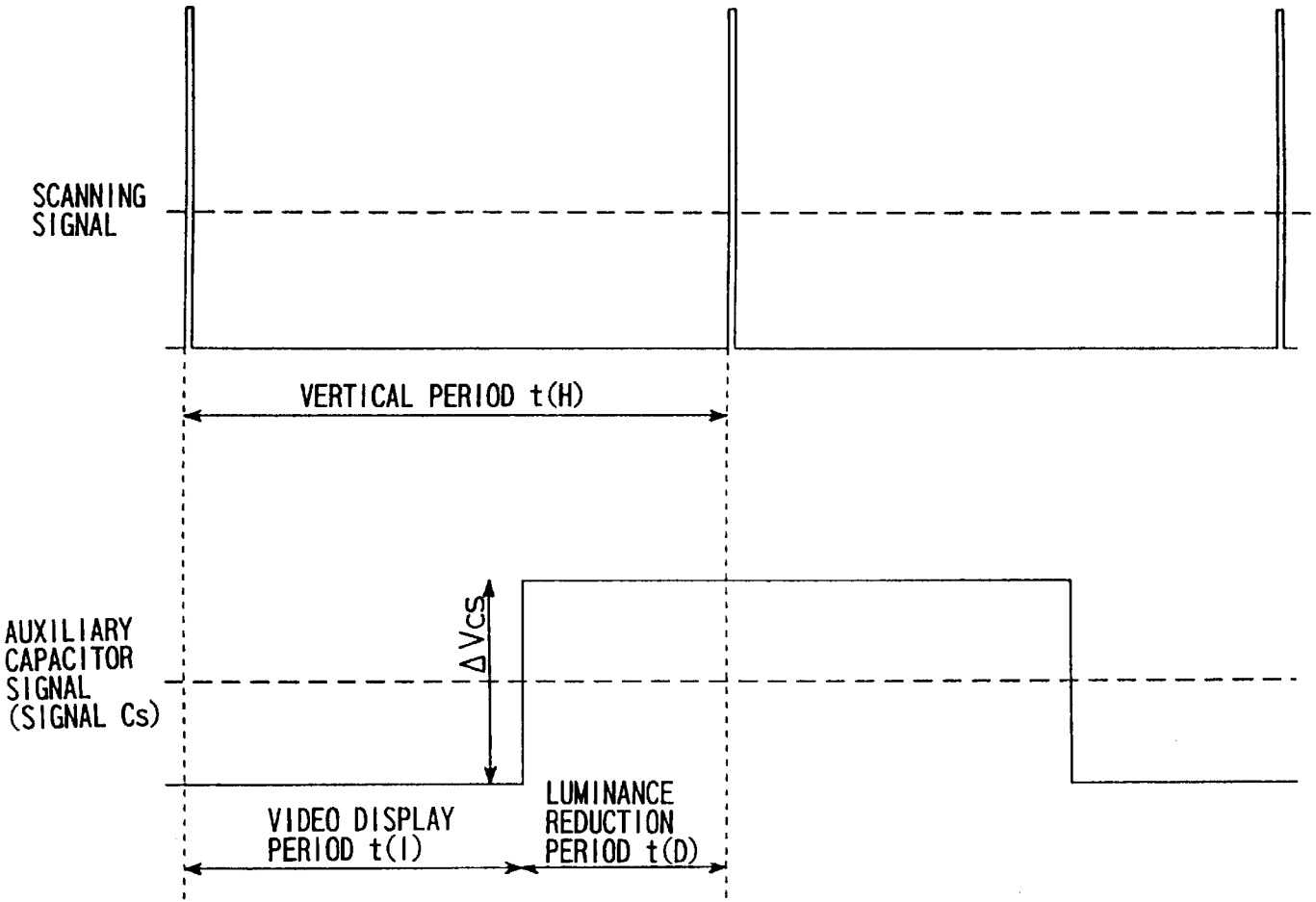
FIG. 3 is a drive timing chart illustrating the relation between the scanning signal and the auxiliary capacitor signal in the active matrix type display apparatus 1 in FIG. 1.

FIG. 3 illustrates the temporal relation between one vertical scanning period as determined by the scanning signal on the scanning lines 2Y and the signal Cs applied to the auxiliary capacitor line 6. When t(H) is the vertical period, t(I) is the video display period in which the video signal is displayed after the start of the vertical period t(H), and t(D) is the luminance reduction period following the video display period t(I), then it is preferable to set $10\% \leqq t(D)/t(H) \leqq 70\%$. The value of t(D)/t(H) is the proportion of black or almost black display, and when this proportion is less than 10%, then the effect of improving the after-image characteristics of high speed moving images by driving with pseudo-impulse display mode becomes small. On the other hand, when the time of black or almost black display becomes too long, then the display luminance and the display contrast are greatly reduced, so that application becomes difficult when the value of t(D)/t(H) is equal to or larger than 70%. In this embodiment, the video display period t(I) during which the video signal is displayed accounts for 70% of each vertical period, whereas the luminance reduction period t(D) of black or almost black display accounts for 30% of each vertical period.

When driving in pseudo-impulse display mode, the effect of improving the after-image characteristics is achieved to some degree even when the display is not completely black during the luminance reduction period but only nearly black. Consequently, when Vc is an intermediate luminance display voltage of the liquid crystal and the previously mentioned ΔVd satisfies $\Delta Vd>Vc$, a certain effect can be anticipated for an average video signal. This means that when the displacement ΔVcs of the auxiliary capacitor signal is in the range given by $|\Delta Vcs|>Vc\times Cp/Ccs$, then the effect of pseudo-impulse display can be anticipated. Using a normally white mode liquid crystal with a black display voltage of 5 V, Cp is set to 0.45 pF, Ccs is set to 0.15 pF, and $|\Delta Vcs|$ is set to 15 V. Thus, ΔVd becomes $\Delta Vd=15\times 0.15/0.45=5.0$ (V) during white display with Vd=0, and black display becomes possible.

Figure 4:
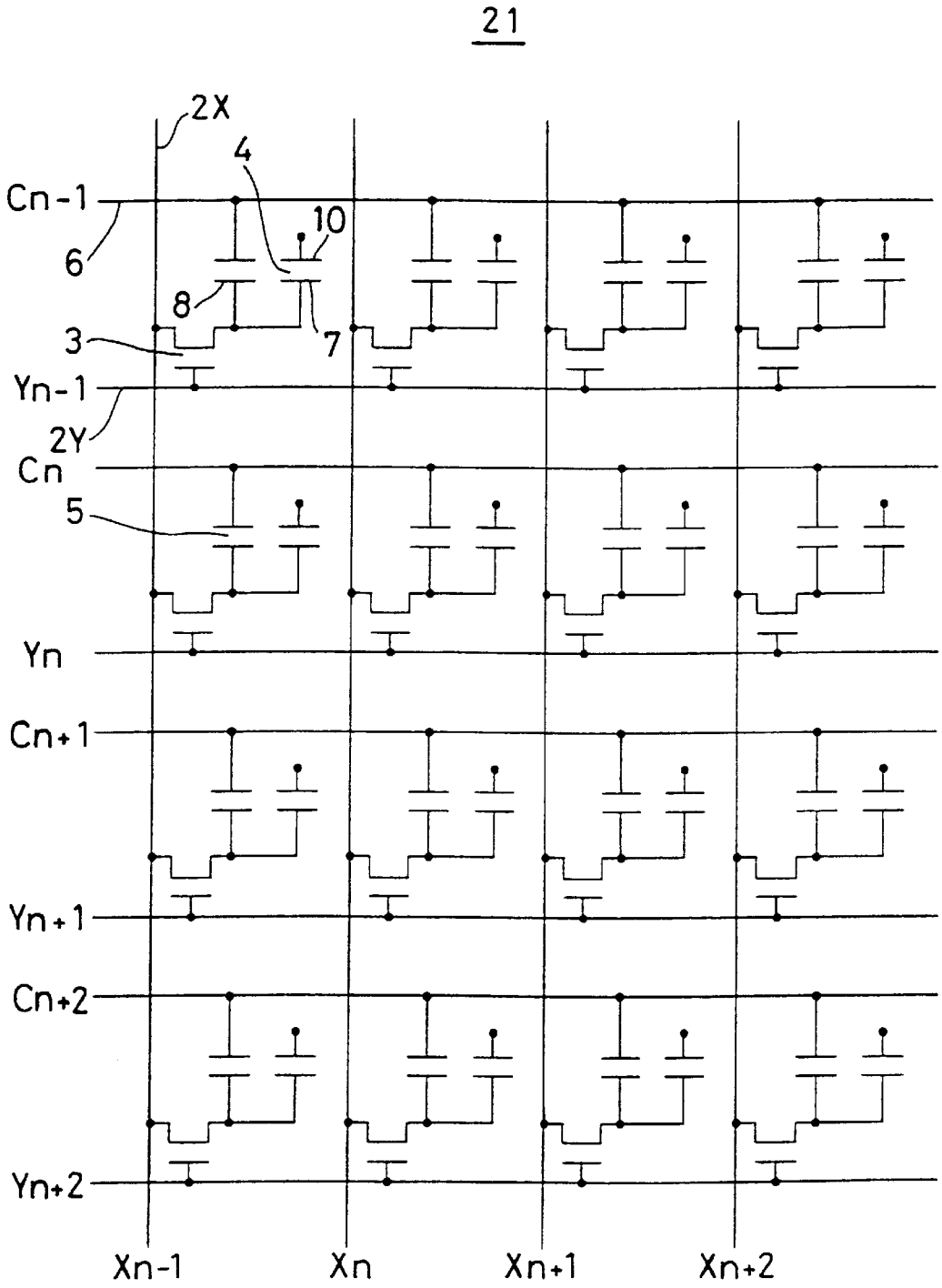
FIG. 4 is an equivalent circuit diagram of an active matrix type display apparatus 21 according to a first embodiment of the invention.

FIG. 4 shows a partial equivalent circuit diagram of an active matrix type display apparatus 21 according to a first embodiment of the invention. In this embodiment, the auxiliary capacitors 5 of the liquid crystal capacitors 4 are lined up along the scanning lines 2Y to which the scanning signals Yn−1, Yn, Yn+1, Yn+2, etc. are applied sequentially, and the electrodes that are not the auxiliary capacitor electrodes 8 of those lined up auxiliary capacitors 5 are short-circuited with the auxiliary capacitor lines 6 and driven by a driver through the auxiliary capacitor lines 6, so that the luminance for the pixel electrodes 4 can be modulated simultaneously. The auxiliary capacitor lines 6 are arranged in parallel to the scanning lines 2Y, and the auxiliary capacitor lines applying the auxiliary capacitor signals Cn−1, Cn, Cn+1, Cn+2 correspond to the scanning lines 2Y applying the scanning signals Yn−1, Yn, Yn+1, Yn+2, respectively.

Figure 5:
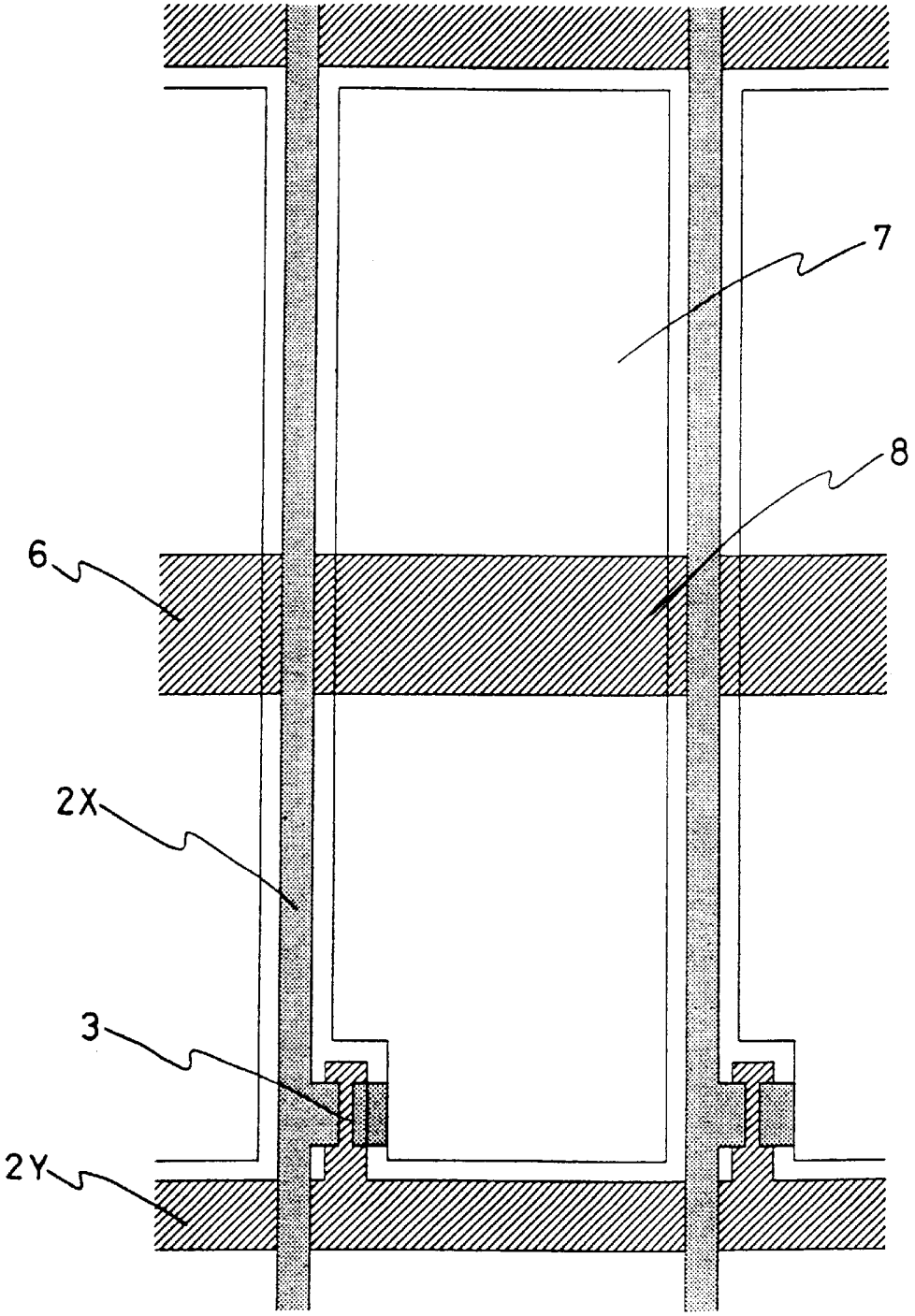
FIG. 5 shows an example of the arrangement of the electrodes and signal lines at the pixels of the active matrix type display apparatus 21 in FIG. 4.
Figure 6:
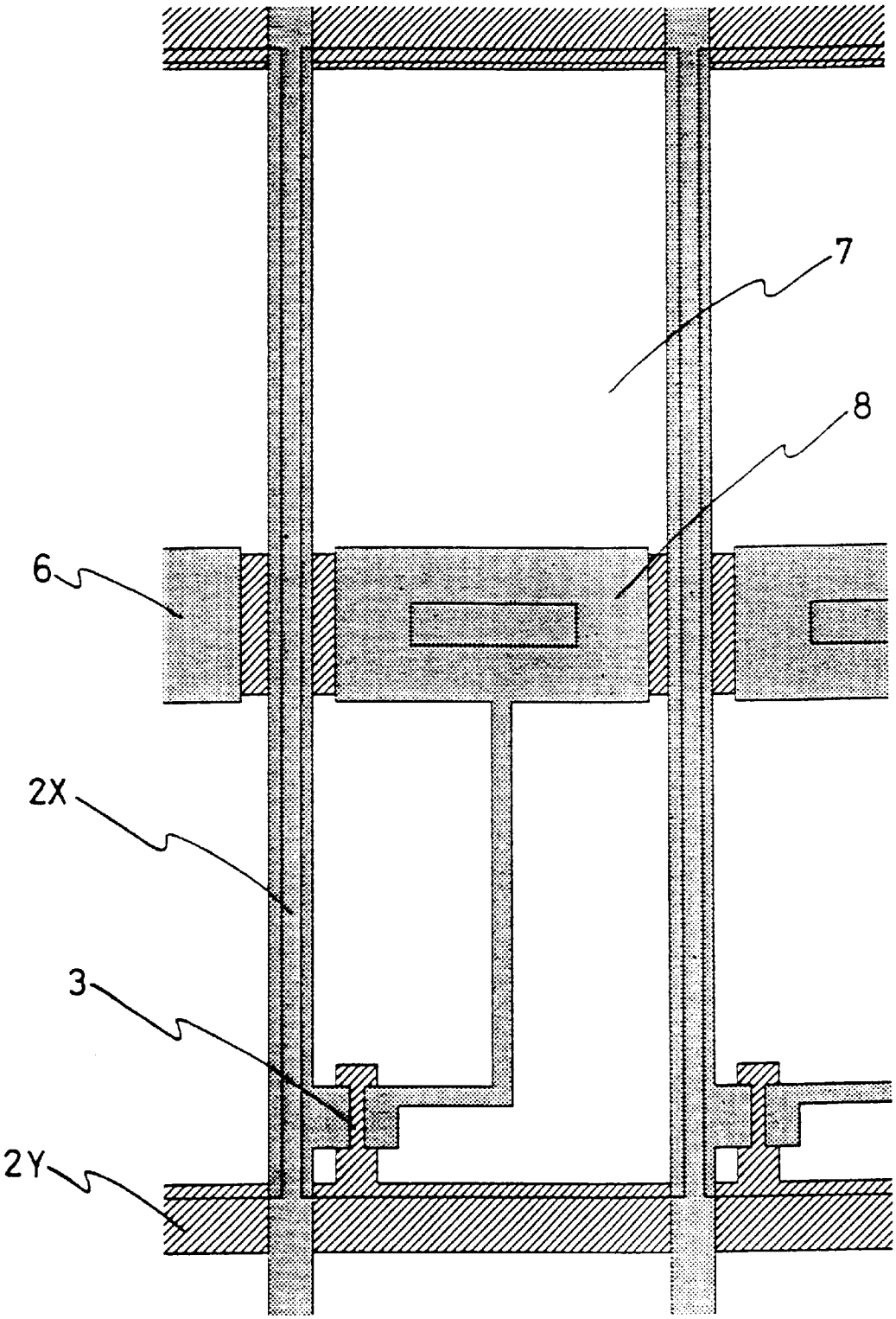
FIG. 6 shows another example of the arrangement of the electrodes and signal lines at the pixels of the active matrix type display apparatus 21 in FIG. 4.

FIGS. 5 and 6 are diagrams showing structure examples of a pixel for realizing the active matrix type display apparatus 21 of the embodiment shown in FIG. 4. The auxiliary capacitor line 6 is formed between the scanning lines 2Y and in parallel thereto. In the structure shown in FIG. 5, the auxiliary capacitor electrode 8 is formed at the portion where the pixel electrode 7 and the auxiliary scanning line 6 overlap. In the structure shown in FIG. 6, the auxiliary capacitor electrode 8 is formed separately from the pixel electrode 7.

Figure 7:
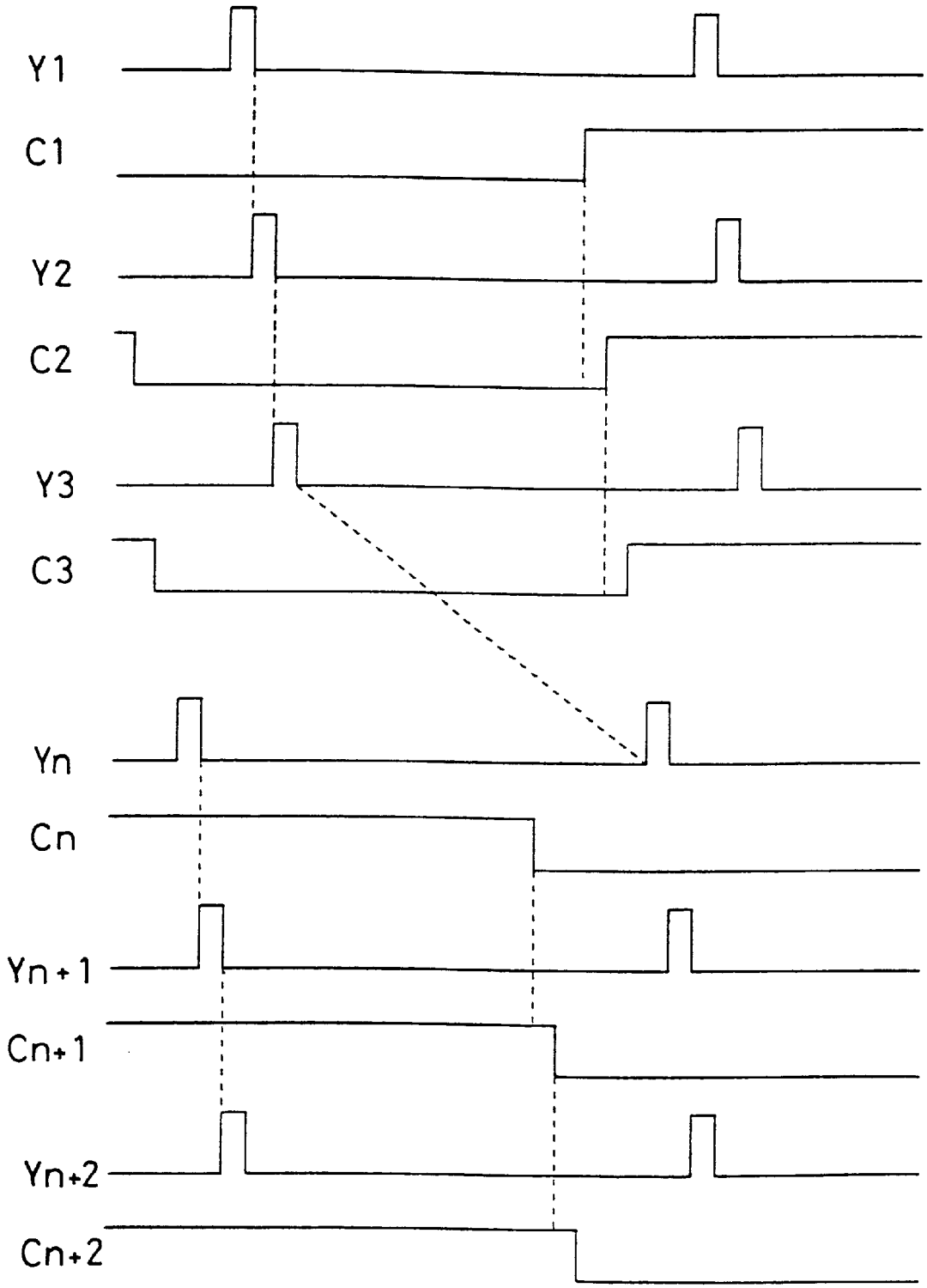
FIG. 7 is a drive timing chart for the active matrix type display apparatus 21 in FIG. 4.

FIG. 7 illustrates in an example of frame inversion the temporal relation between the scanning signal and the auxiliary capacitor signal for the active matrix type display apparatus 21 of the embodiment shown in FIG. 4. The ON pulses of the scanning signals Y1, Y2, Y3, . . . , Yn, Yn+1, Yn+2, are applied sequentially, shifting to the next scanning line after a certain time, and one ON pulse per vertical period is applied to each scanning line. After the ON pulses of the scanning signals Y1, Y2, Y3, . . . , Yn, Yn+1, Yn+2 have been applied, and after a certain period of time shorter than one vertical period has passed, the potential differences of the auxiliary capacitor signals C1, C2, C3, . . . , Cn, Cn+1, Cn+2 are applied correspondingly to the auxiliary capacitor lines parallel to the scanning lines. That is to say, the potential differences of the auxiliary capacitor signals C1, C2, C3, . . . , Cn, Cn+1, Cn+2 are shifted by a delay that is equivalent to a constant time delay within one frame cycle of the ON pulses of the scanning signals Y1, Y2, Y3, . . . , Yn, Yn+1, Yn+2.

Figure 8:
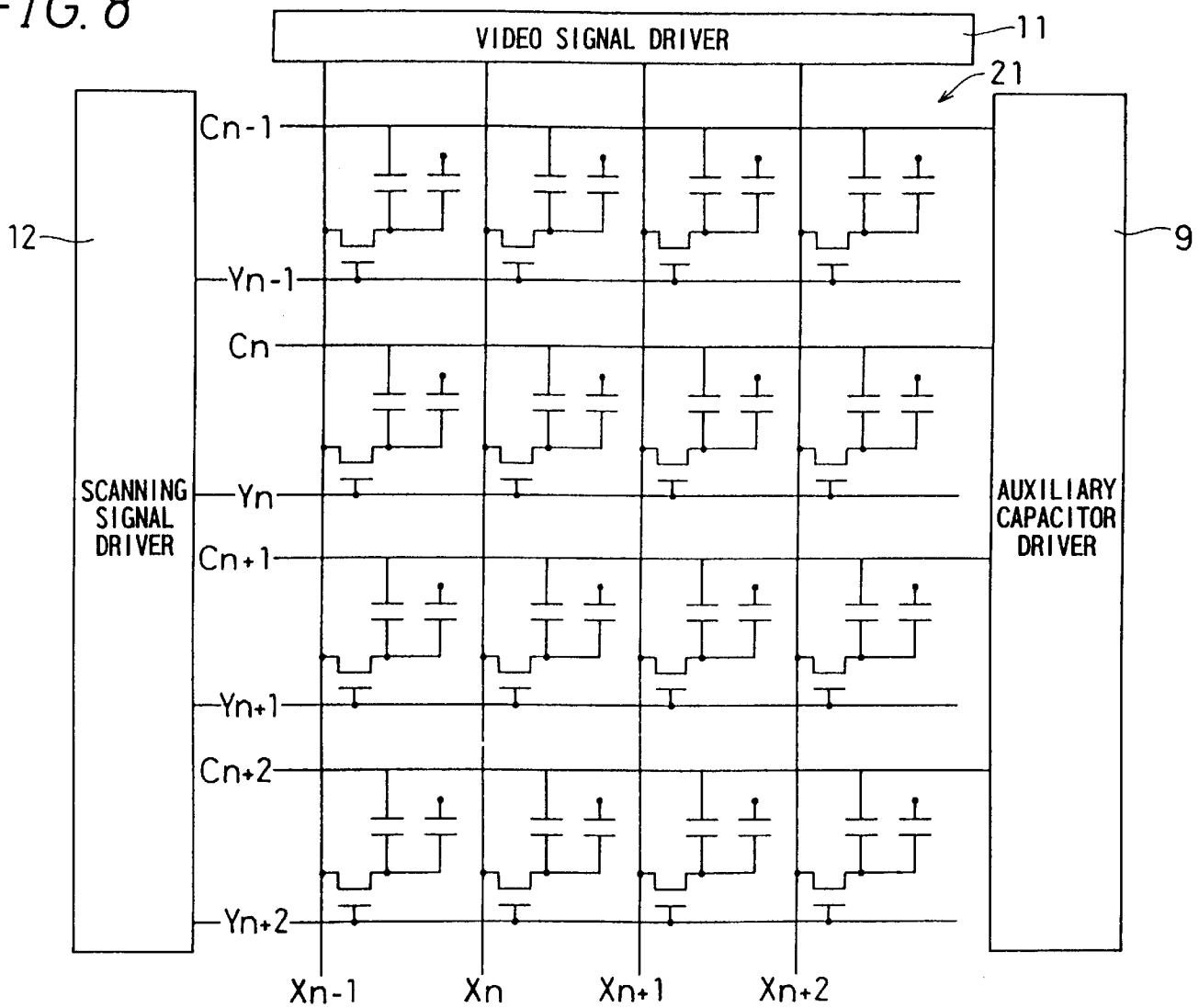
FIG. 8 is an equivalent circuit diagram illustrating the electrical configuration of the active matrix type display apparatus 21 in FIG. 4.

FIG. 8 shows the circuit configuration including the driver for driving the active matrix type display apparatus 21 of the embodiment shown in FIG. 4. The signal lines 2X are connected to a video signal driver 11, which applies the video signals Xn−1, Xn, Xn+1, Xn+2 to the signal lines 2X. The scanning lines 2Y are connected to a scanning signal driver 12, which sequentially applies the ON pulses of the scanning signals Yn−1, Yn, Yn+1, Yn+2 to the scanning lines 2Y, shifting over time. The auxiliary capacitor lines 6 parallel to the scanning lines 2Y are connected to an auxiliary capacitor driver 9, which applies the auxiliary capacitor signals Cn−1, Cn, Cn+1, Cn+2 to the auxiliary capacitor lines 6. It is also possible to drive all scanning lines 2Y and auxiliary capacitor lines 6 with one driver which combines the functions of the scanning signal driver 12 and the auxiliary capacitor driver 9.

Figure 9:
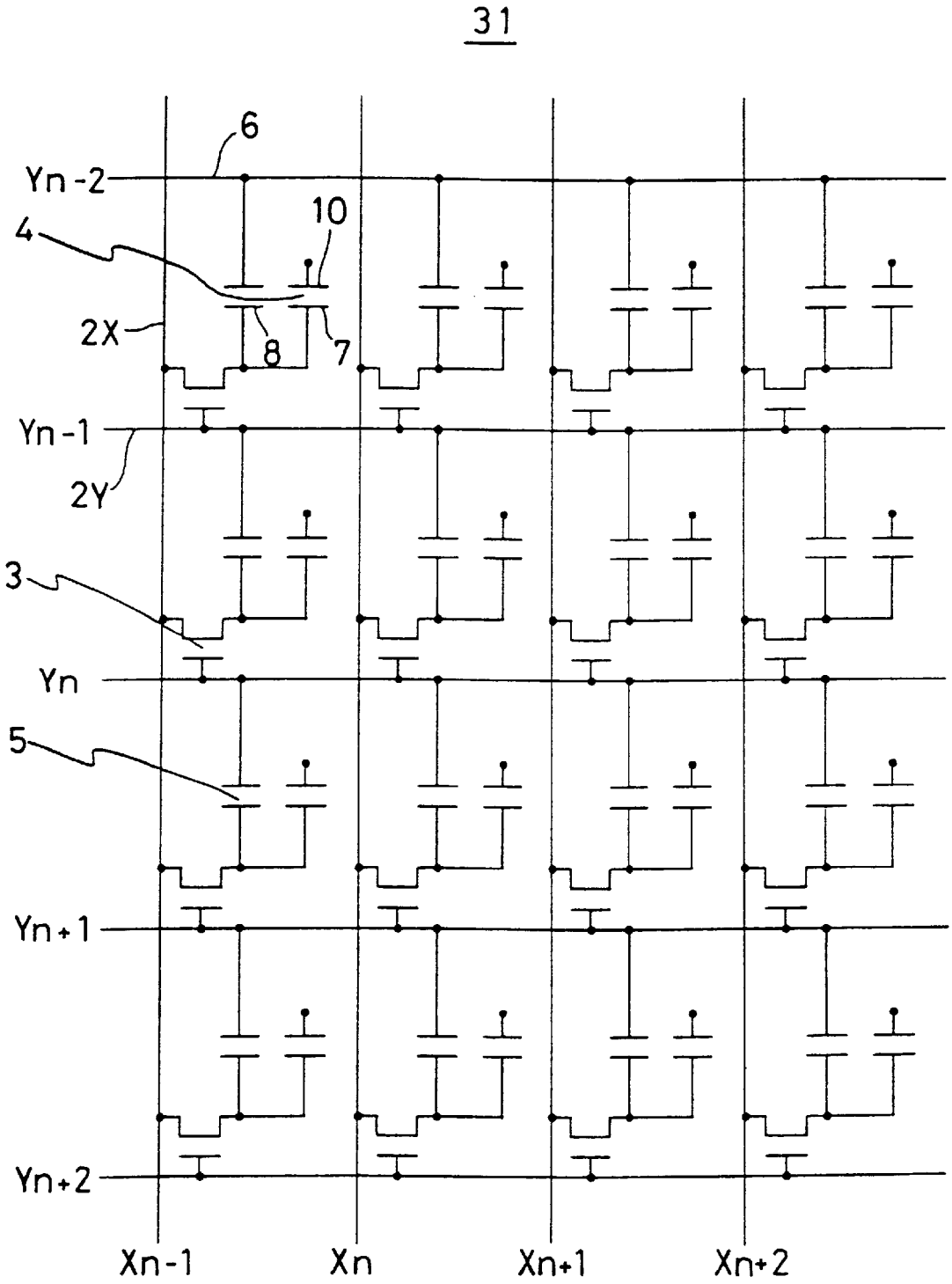
FIG. 9 is an equivalent circuit diagram of an active matrix type display apparatus 31 according to a second embodiment of the invention.

FIG. 9 shows an equivalent circuit diagram of an active matrix type display apparatus 31 according to a second embodiment of the invention. In the active matrix type display apparatus 31 of this embodiment, of those electrodes of the auxiliary capacitors 5 of the pixels that the switching elements 3 have selected for driving with certain scanning lines 2Y, such as the scanning lines corresponding to the scanning signal 2Y, the electrodes that are not the auxiliary capacitor electrodes 8 are connected to the preceding scanning lines, to which the scanning signal Yn−1 is applied. In this embodiment, the auxiliary capacitor signal is overlapped with the preceding scanning signal, thereby attaining a similar effect as in the embodiment shown in FIG. 3. It should be noted that it is sufficient when the electrodes of the auxiliary capacitors 5 that are not the auxiliary capacitor electrodes 8 are connected to an adjacent scanning line, so that they can be connected not only to the preceding scanning line applying the scanning signal Yn−1, but also to the following scanning line applying the scanning signal Yn+1.

Figure 10:
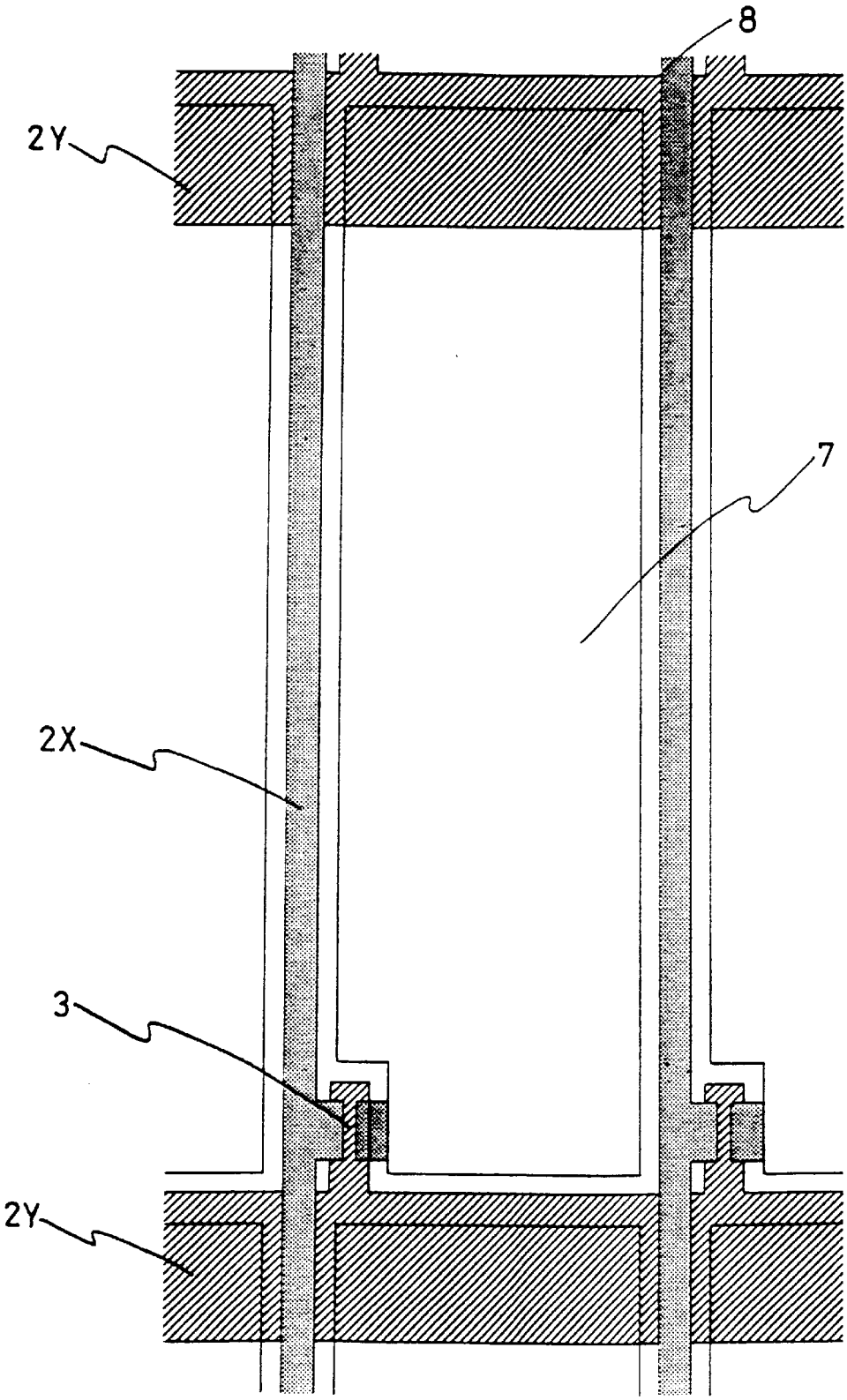
FIG. 10 shows an example of the arrangement of the electrodes and signal lines at the pixels of the active matrix type display apparatus 31 in FIG. 9.
Figure 11:
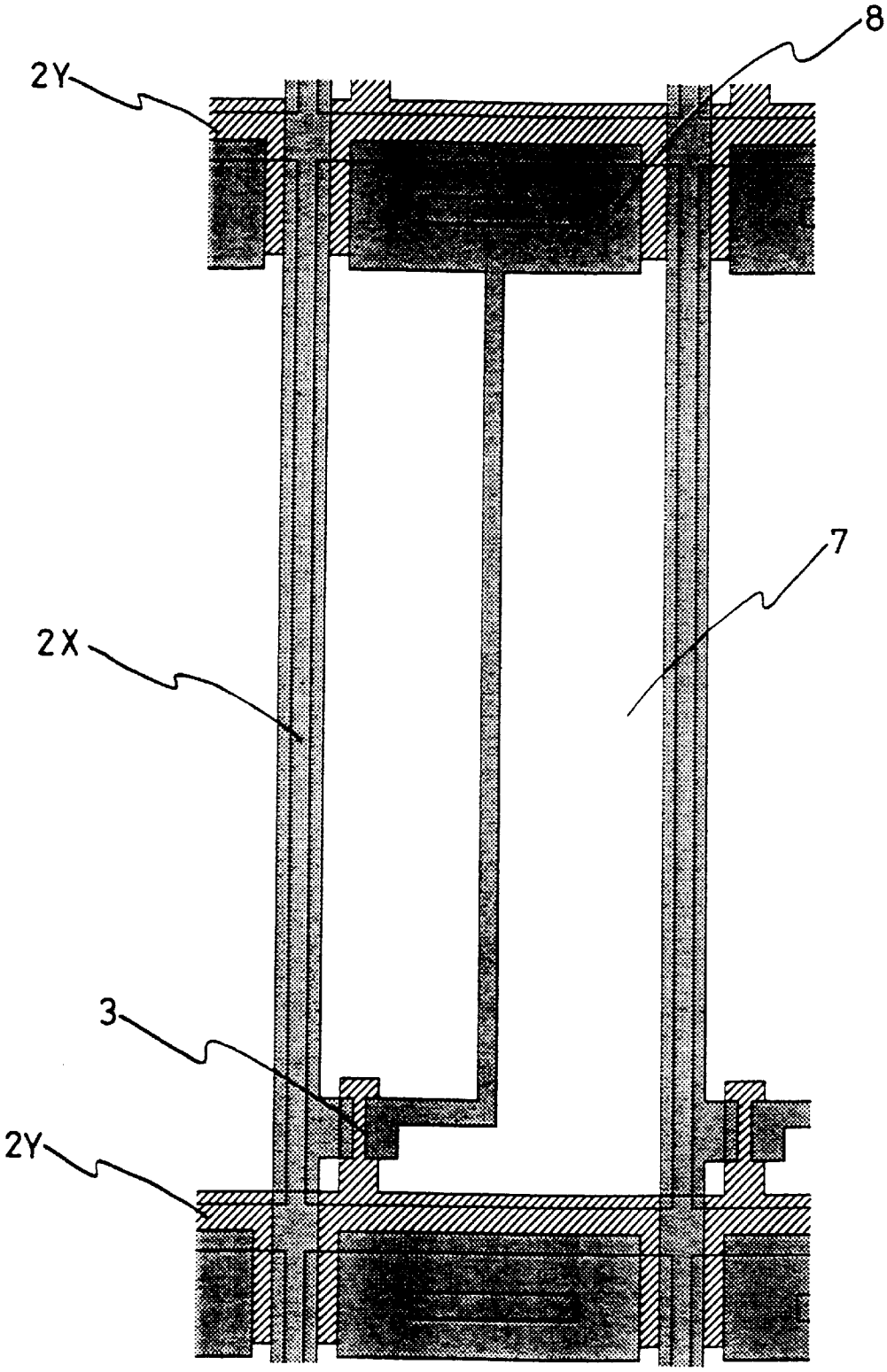
FIG. 11 shows another example of the arrangement of the electrodes and signal lines at the pixels of the active matrix type display apparatus 31 in FIG. 9.

FIGS. 10 and 11 illustrate examples of the layout of the electrodes and signal lines for the pixels of the active matrix type display apparatus 31 of the embodiment shown in FIG. 9. In FIG. 10, the auxiliary capacitor electrode 8 is formed at the portion where the pixel electrode 7 overlaps with the preceding scanning line 2Y. In FIG. 11, the auxiliary capacitor electrode 8 is formed separately from the pixel electrode 7 at the preceding scanning line 2Y. This means, also in this embodiment, the electrodes and signal lines can be arranged based on the same idea as shown in FIGS. 5 and 6 for the active matrix type display apparatus 21 of the embodiment shown in FIG. 4.

Figure 12:
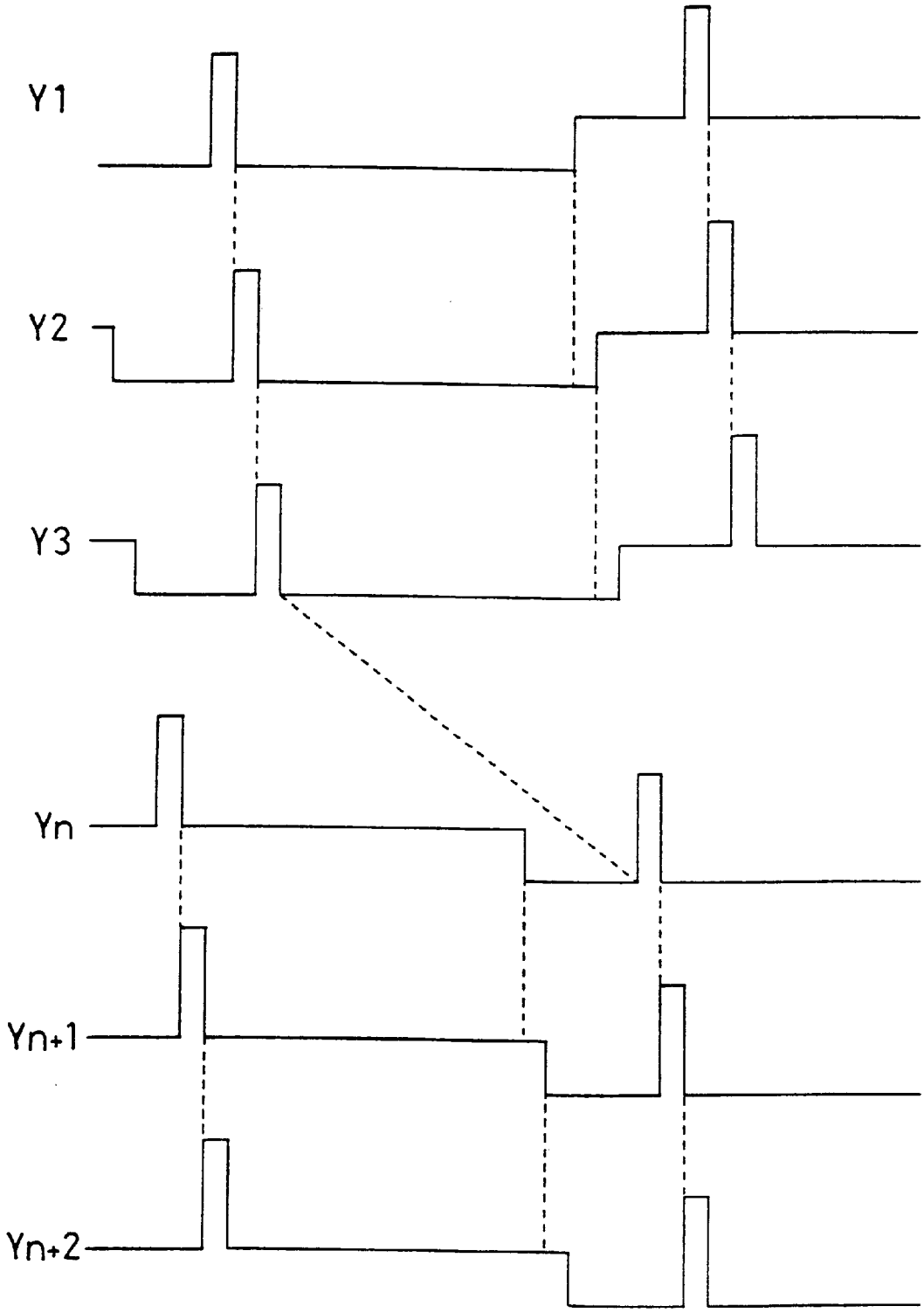
FIG. 12 is a drive timing chart for the active matrix type display apparatus 31 in FIG. 9.

FIG. 12 illustrates in an example of frame inversion the temporal relation between the scanning signals Y1, Y2, Y3, . . . , Yn, Yn+1, Yn+2 applied to the scanning lines 2Y of the present embodiment. As will be appreciated by comparison with the timing chart in FIG. 7 for the active matrix type display apparatus 21 of the embodiment shown in FIG. 4, the scanning signals Y1, Y2, Y3, . . . , Yn, Yn+1, Yn+2 are given by overlapping the scanning signals Y1, Y2, Y3, . . . , Yn, Yn+1, Yn+2 shown in FIG. 7 with the auxiliary capacitor signals C1, C2, C3, . . . , Cn, Cn+1, Cn+2. When the ON pulse of a scanning signal is applied to a scanning line, then a potential change is caused by the ON pulse of the scanning signal in the auxiliary capacitor 5 to which the auxiliary capacitor electrode 8 is connected over the switching element 3 from the scanning line to which an ON pulse is applied at the following timing clock of this scanning line, but this ON pulse is a change for a very short period of time, and does not exert any influence that might lead to a display problem. Furthermore, if the auxiliary capacitor signal for applying through the auxiliary capacitor 5 a change that reduces the luminance of that pixel so as to achieve a black or almost black display is set to a level below the threshold at which the switching element 3 switches to ON, then it can be ensured that the switching element 3 is not made conducting by the auxiliary capacitor signal.

Figure 13:
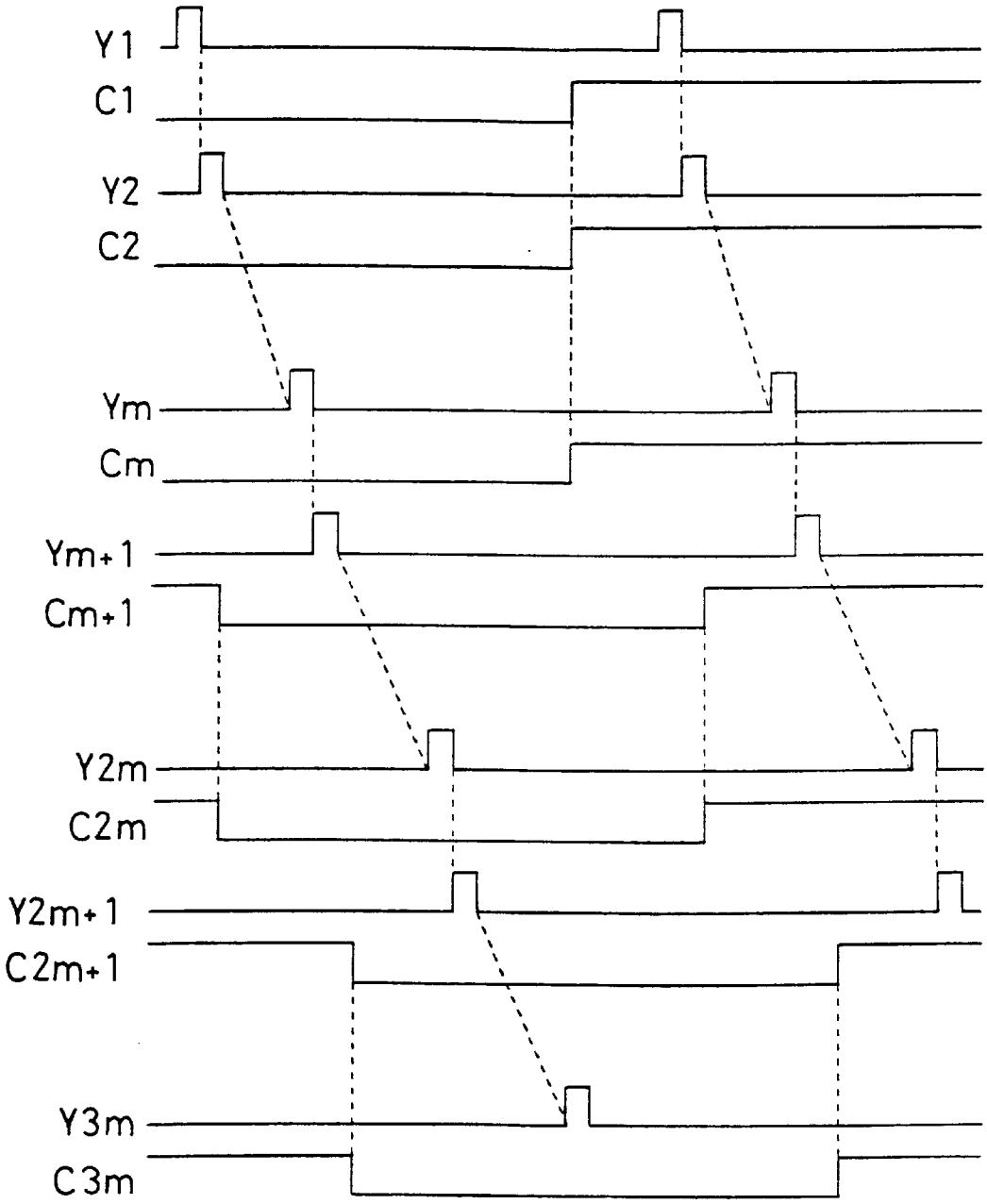
FIG. 13 is a drive timing chart for a third embodiment of the invention.

FIG. 13 illustrates the relation between the auxiliary capacitor signal and the scanning signal in a third embodiment of the invention. In this embodiment, the same auxiliary capacitor signal is applied to a plurality of auxiliary capacitor lines (m auxiliary capacitor lines), so that the auxiliary capacitor driver 9 for driving the auxiliary capacitors 5 can be simplified. That is to say, an identical auxiliary capacitor signal is applied as the signals C1, C2, . . . , Cm to the auxiliary capacitor lines arranged in parallel to the corresponding scanning lines to which the scanning signals Y1, Y2, . . . , Ym are applied, and an identical auxiliary capacitor signal is also applied correspondingly to each following set of m scanning lines.

Figure 14:
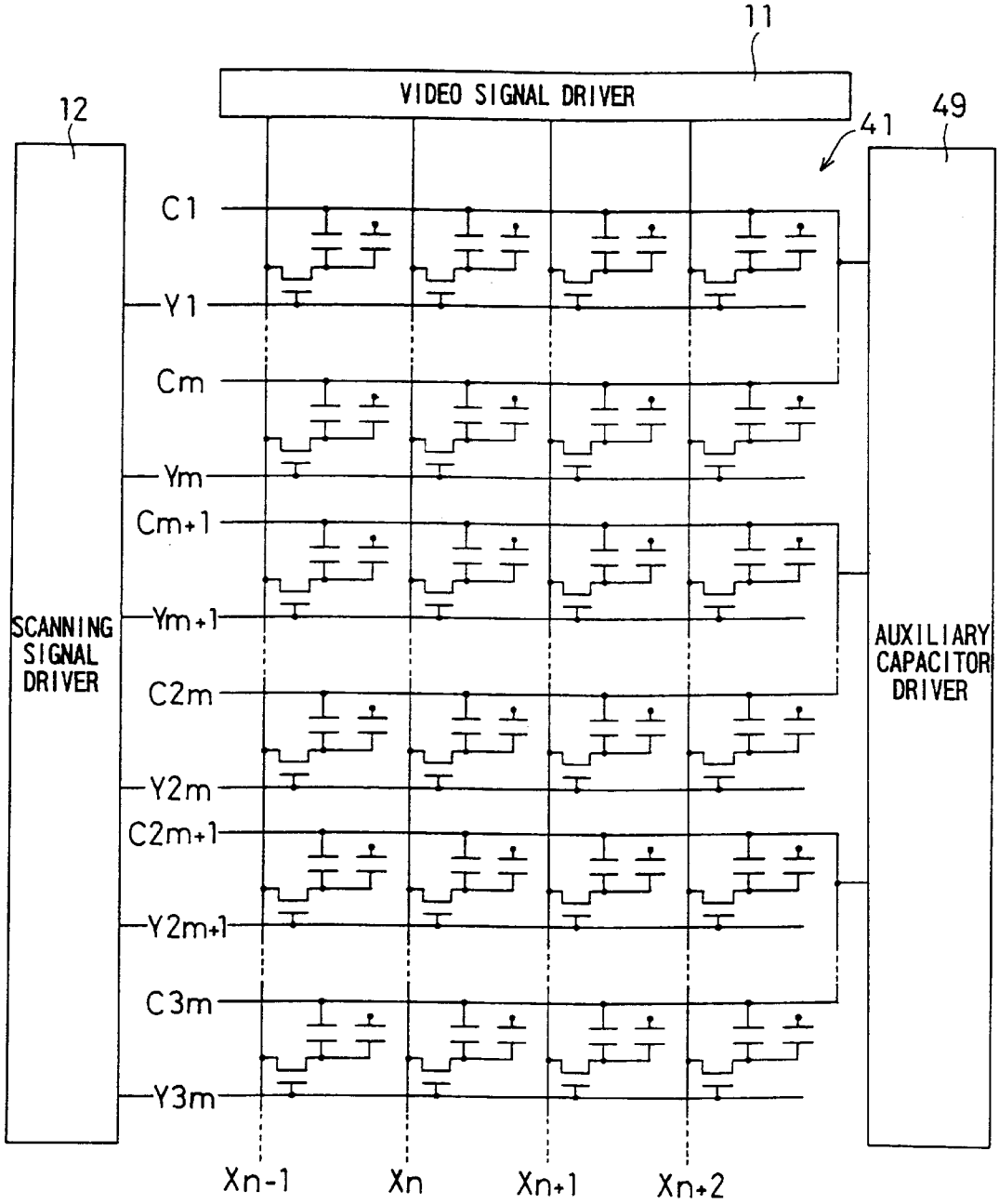
FIG. 14 is an equivalent circuit diagram illustrating the electrical configuration of an active matrix type display apparatus 41, in which the auxiliary capacitors are driven with the timing shown in FIG. 13.

FIG. 14 shows the circuit configuration of an active matrix type display apparatus 41 of this embodiment. In this embodiment, the auxiliary capacitor lines 6, driven by an auxiliary capacitor driver 49, are short-circuited in bundles of m auxiliary capacitor lines 6. For example, in an active matrix type display apparatus 41 with 768 scanning lines, m can be set to m=32. The idea of employing the same timing for the auxiliary capacitor lines corresponding to a plurality of scanning lines as in this embodiment can also be applied to the active matrix type display apparatus 31 of the embodiment shown in FIG. 9. However, in the active matrix type display apparatus 31 shown in FIG. 9, also driving through the auxiliary capacitors 5 is performed with the scanning signal driver, so that the signal overlapped as the same signal with m auxiliary capacitor signals C1, C2, C3, . . . , Cn, Cn+1, Cn+2 overlapping the original scanning signals Y1, Y2, Y3, . . . , Yn, Yn+1, Yn+2 should be supplied by the scanning signal driver to the scanning lines as the scanning signals Y1, Y2, Y3, . . . , Yn, Yn+1, Yn+2.

It is preferable that the each of the auxiliary capacitor lines 6 is driven with a different timing, but it is also possible to bundle a plurality of the auxiliary capacitor lines 6 as described above. In practice, for example in JP-A 11-202285 and JP-A 11-202286, the backlight emission region in one screen is divided into four partitions, and it seems that also in the invention, it is possible to bundle the auxiliary capacitor lines 6 together, until dividing one screen at least into four partitions. That is to say, it is possible to bundle two to a certain number of the auxiliary capacitor lines 6 together into one group, wherein the certain number is the number of auxiliary capacitor lines 6 when partitioning one screen at least into four regions, and drive each group with the same timing. However, whether partition is possible or not will depend on the amount of improvement of the after-image characteristics and the image quality demanded for display of moving images, and the tolerance range will differ depending on the user. Applying the invention, it is possible to improve the visibility during display of moving images by improving the after-image characteristics, regardless of this range.

Figure 15:
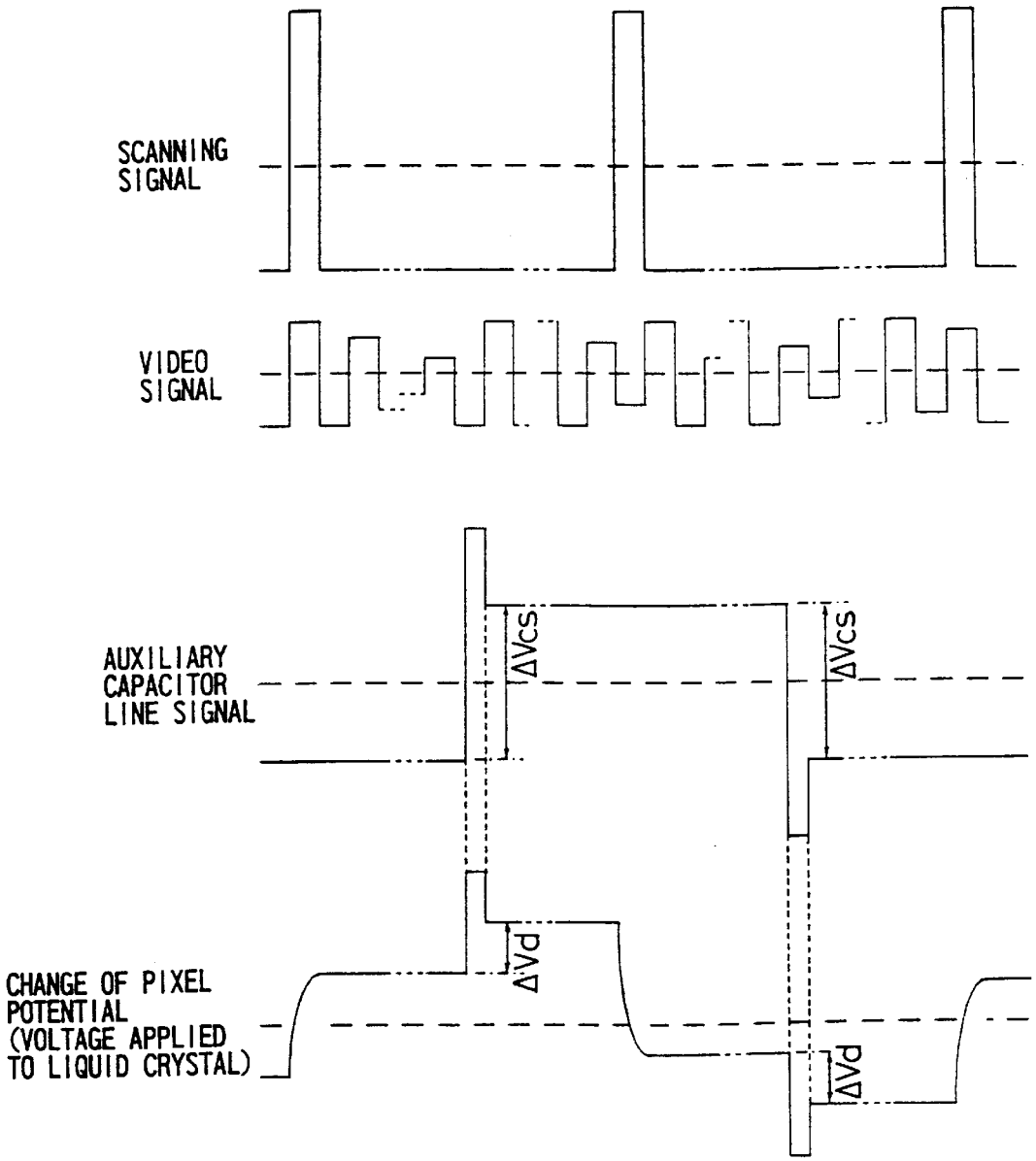
FIG. 15 is a drive timing chart for driving the auxiliary capacitors in a fourth embodiment of the invention.

FIG. 15 illustrates the waveform of the auxiliary capacitor signal in the fourth embodiment of the invention. In this embodiment, when the potential of the auxiliary capacitor signal changes, a level change that is larger than the level change of the hitherto applied differential portion ΔVcs is applied initially as an overshooting voltage, accelerating the response of the liquid crystal toward black or nearly black display. Thus, the image quality during the display of moving images can be improved.

Figure 16:
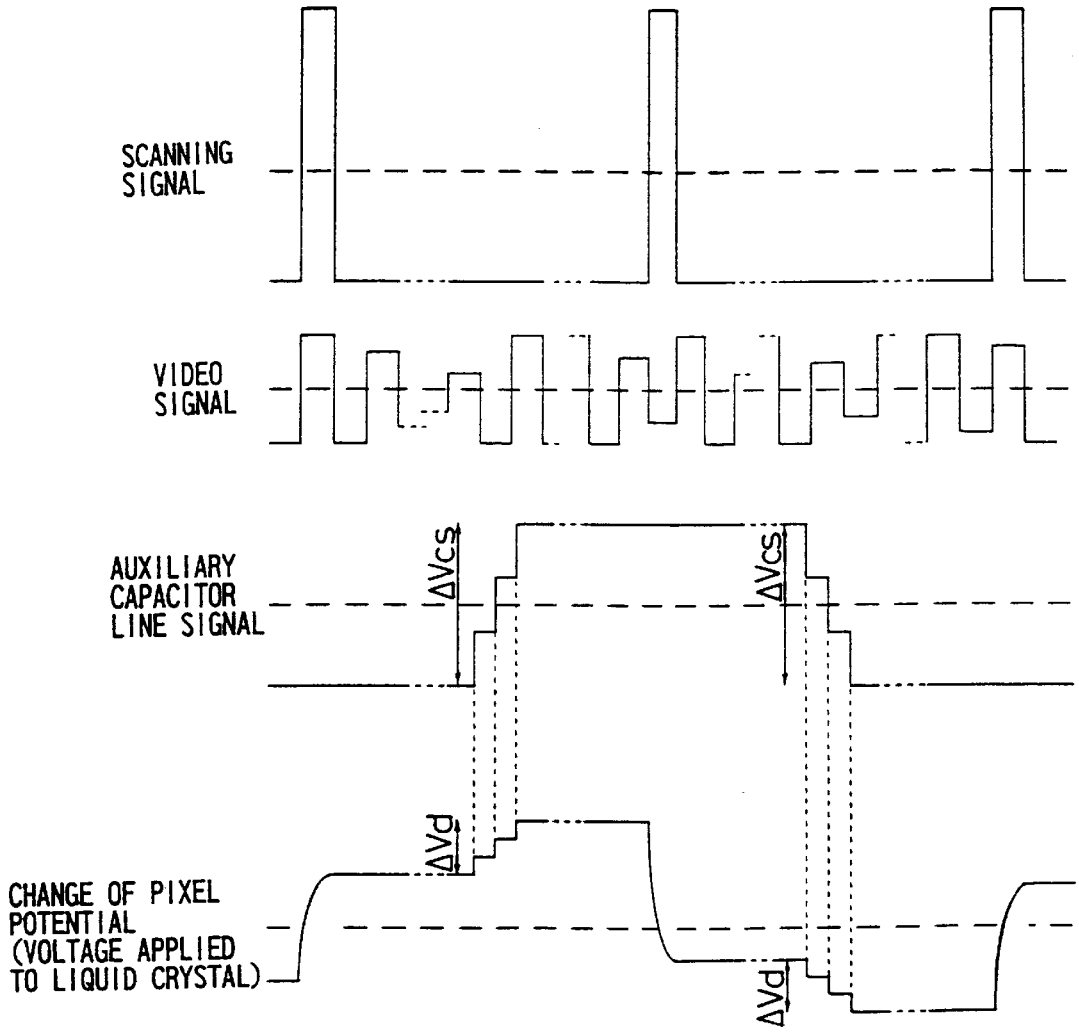
FIG. 16 is a drive timing chart for driving the auxiliary capacitors in a fifth embodiment of the invention.
Figure 17:
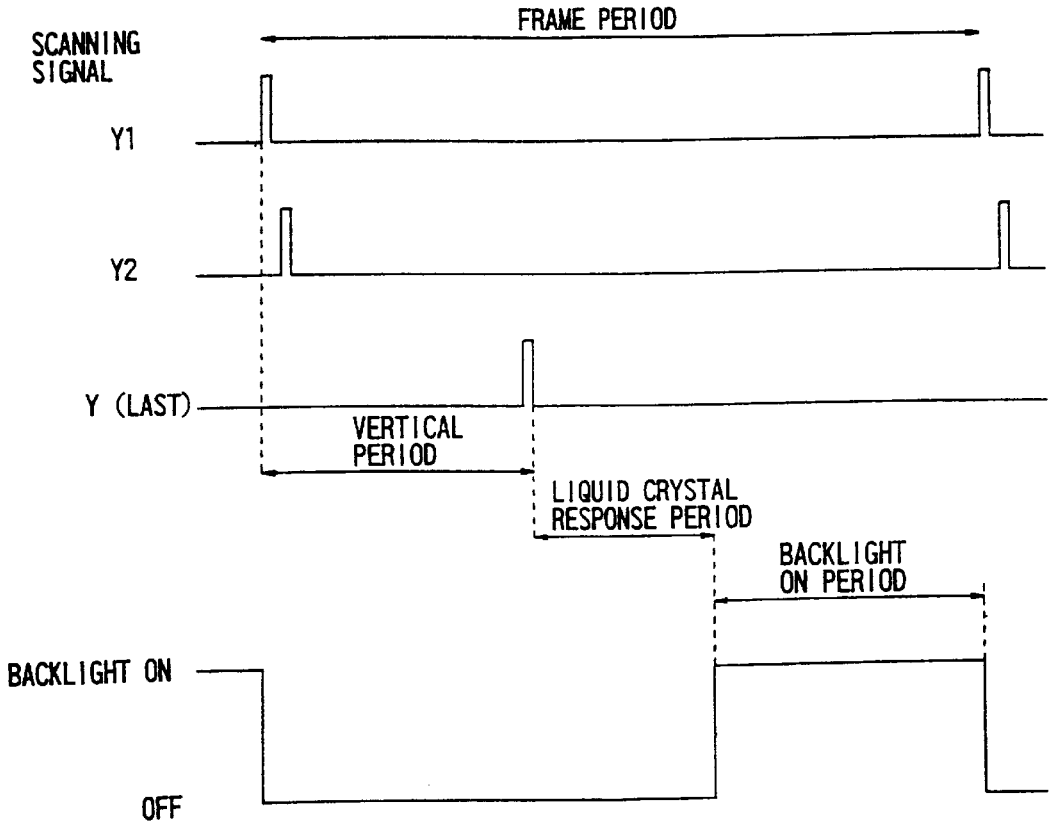
FIG. 17 is a conventional drive timing chart for pseudo-impulse display by turning the backlight on and off.
Figure 18:
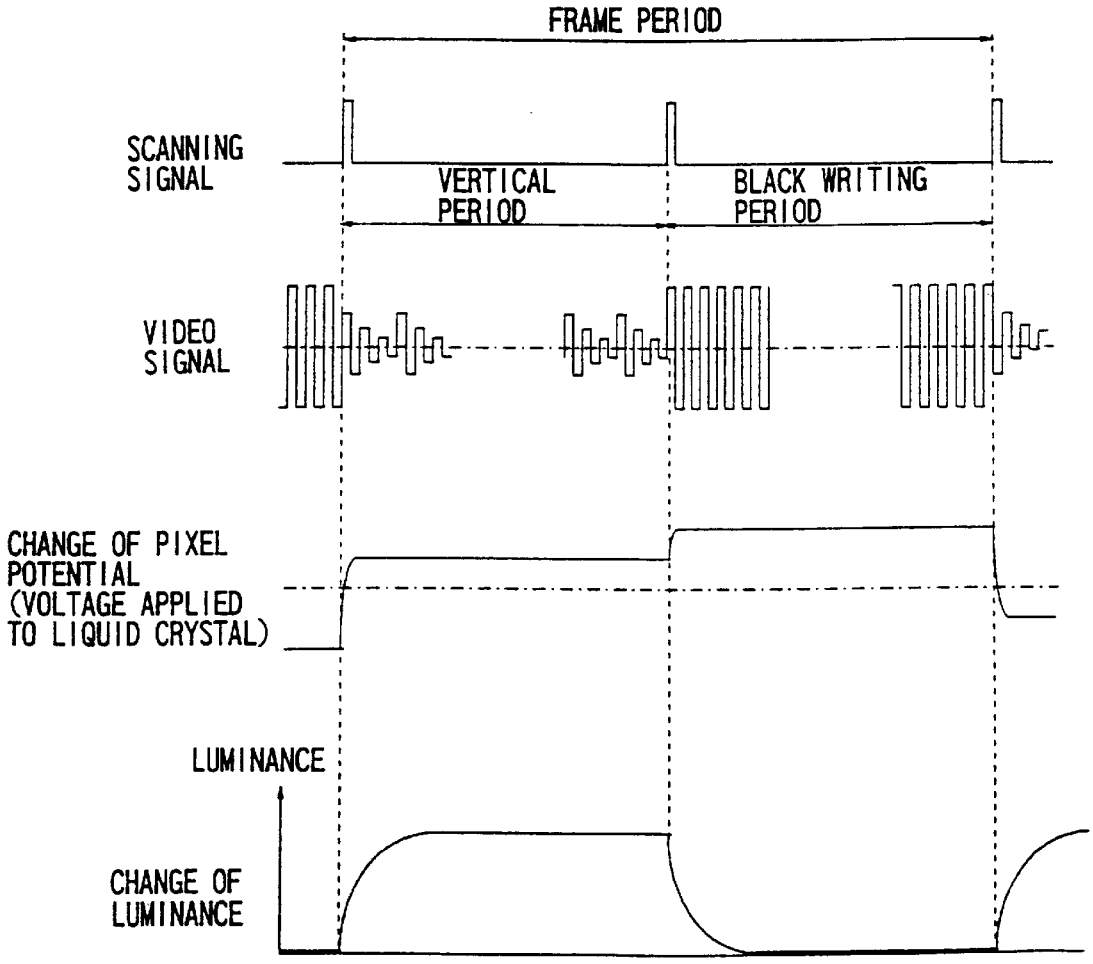
FIG. 18 is a conventional drive timing chart for pseudo-impulse display by providing a black writing period in each frame period.

FIG. 16 illustrates the waveform of the auxiliary capacitor signal in a fifth embodiment of the invention. In this embodiment, the predetermined differential portion ΔVcs of the auxiliary capacitor signal is changed stepwise over a plurality of steps. Thus, the load on the auxiliary capacitor driver can be reduced, and especially the load can be reduced when the auxiliary capacitors corresponding to a plurality of scanning lines are collectively driven by the one and same driver.

The foregoing embodiments related to an image display using a liquid crystal, but they can also be applied to display methods other than active matrix type display, improving the after-image characteristics so as to increase the image quality for moving image display.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An active matrix type display apparatus comprising:

a plurality of signal lines;

a plurality of scanning lines intersecting with the signal lines;

switching elements arranged at intersections of the signal lines and the scanning lines, the switching elements being selectively put into a conductive state for a predetermined period of time per vertical period in accordance with a scanning signal on the scanning lines;

pixel capacitors arranged at the intersections and driven by a video signal on the signal lines through the switching elements in the conducting state, an image being displayed depending on a charge state of the pixel capacitors;

auxiliary capacitors associated with respective pixel capacitors, one side of each of the auxiliary capacitors being connected to at least one of the switching elements;

a plurality of auxiliary capacitor lines, the other side of each of the auxiliary capacitors being connected to at least one of the auxiliary capacitor lines; and a driver for driving the auxiliary capacitor lines such that a display luminance is reduced for a predetermined period of time after reaching the display luminance corresponding to the video signal while the switching elements are in the non-conducting state in accordance with the scanning signal on the scanning lines.

2. An active matrix type display apparatus comprising:

a plurality of signal lines;

a plurality of scanning lines intersecting with the signal lines;

switching elements arranged at intersections of the signal lines and the scanning lines, the switching elements being selectively put into a conductive state for a predetermined period of time per vertical period in accordance with a scanning signal on the scanning lines;

pixel capacitors arranged at the intersections and driven by a video signal on the signal lines through the switching elements in the conducting state, an image being displayed depending on a charge state of the pixel capacitors;

auxiliary capacitors associated with respective pixel capacitors, one side of each of the auxiliary capacitors being connected to at least one of the switching elements;

a plurality of auxiliary capacitor lines, the other side of each of the auxiliary capacitors being connected to at least one of the auxiliary capacitor lines; and a driver for driving the auxiliary capacitor lines such that a signal of the same polarity as a video signal having a predetermined amplitude is applied at least once per vertical period, after applying a display signal corresponding to the video signal while the switching elements are in the non-conducting state in accordance with the scanning signal on the scanning lines.

3. The active matrix type display apparatus of claim 1, wherein with respect to the scanning lines which select the switching elements, the auxiliary capacitors are divided into groups of a plurality of auxiliary capacitors, the group being associated with a plurality of neighboring scanning lines, and that the driver collectively drives all auxiliary capacitor lines connected to a group of auxiliary capacitors.

4. The active matrix type display apparatus of claim 1, wherein the auxiliary capacitor lines driven by the driver are formed in parallel to the scanning lines.

5. The active matrix type display apparatus of claim 1, wherein an active matrix is formed such that the auxiliary capacitor lines connected to the other sides of the auxiliary capacitors driven by the switching elements to which the scanning signal is applied from the scanning lines also serve as the respectively adjacent scanning lines, and the driver carries out driving for the auxiliary capacitors and driving for scanning the switching elements connected to the adjacent scanning lines.

6. The active matrix type display apparatus of claim 1, wherein the pixel capacitors include a liquid crystal layer arranged between opposing electrodes, and display is performed in normally white display mode, such that display luminance is high when a voltage applied between the electrodes is low, and display luminance is low when the voltage applied between the electrodes is high.

7. The active matrix type display apparatus of claim 2, wherein with respect to the scanning lines which select the switching elements, the auxiliary capacitors are divided into groups of a plurality of auxiliary capacitors, the group being associated with a plurality of neighboring scanning lines, and that the driver collectively drives all auxiliary capacitor lines connected to a group of auxiliary capacitors.

8. The active matrix type display apparatus of claim 2, wherein the auxiliary capacitor lines driven by the driver are formed in parallel to the scanning lines.

9. The active matrix type display apparatus of claim 2, wherein an active matrix is formed such that the auxiliary capacitor lines connected to the other sides of the auxiliary capacitors driven by the switching elements to which the scanning signal is applied from the scanning lines also serve as the respectively adjacent scanning lines, and the driver carries out driving for the auxiliary capacitors and driving for scanning the switching elements connected to the adjacent scanning lines.

10. The active matrix type display apparatus of claim 2, wherein the pixel capacitors include a liquid crystal layer arranged between opposing electrodes, and display is performed in normally white display mode, such that display luminance is high when a voltage applied between the electrodes is low, and display luminance is low when the voltage applied between the electrodes is high.

11. A method for driving an active matrix type display apparatus comprising a plurality of signal lines; a plurality of scanning lines intersecting with the signal lines; switching elements arranged at intersections of the signal lines and the scanning lines, the switching elements being selectively put into a conductive state for a predetermined period of time per vertical period in accordance with a scanning signal on the scanning lines; pixel capacitors arranged at the intersections and driven by a video signal on the signal lines through the switching elements in the conducting state, an image being displayed depending on a charge state of the pixel capacitors; auxiliary capacitors associated with respective pixel capacitors, one side of each of the auxiliary capacitors being connected to at least one of the switching elements; and a plurality of auxiliary capacitor lines, the other side of each of the auxiliary capacitors being connected to at least one of the auxiliary capacitor lines, the method comprising:

driving the auxiliary capacitor lines for a predetermined period of the period after reaching a display luminance corresponding to the video signal in which the switching elements are in the non-conducting state in accordance with the scanning signal on the scanning lines, such that a charge state of the pixel capacitors connected to the switching elements changes to a display luminance reduction side.

12. A method for driving an active matrix type display apparatus comprising a plurality of signal lines; a plurality of scanning lines intersecting with the signal lines; switching elements arranged at intersections of the signal lines and the scanning lines, the switching elements being selectively put into a conductive state for a predetermined period of time per vertical period in accordance with a scanning signal on the scanning lines; pixel capacitors arranged at the intersections and driven by a video signal on the signal lines through the switching elements in the conducting state, an image being displayed depending on a charge state of the pixel capacitors; auxiliary capacitors associated with respective pixel capacitors, one side of each of the auxiliary capacitors being connected to at least one of the switching elements; and a plurality of auxiliary capacitor lines, the other side of each of the auxiliary capacitors being connected to at least one of the auxiliary capacitor lines, the method comprising:

driving the auxiliary capacitor lines for a period of time after applying a display signal corresponding to the video signal in which the switching elements are in the non-conducting state in accordance with the scanning signal on the scanning lines, such that a signal of the same polarity as the video signal having a predetermined amplitude is applied at least once per vertical period.

13. The method for driving an active matrix type display apparatus of claim 11, wherein the pixel capacitors include a liquid crystal layer arranged between opposing electrodes, and display is performed in normally white display mode, such that the display luminance is high when the voltage applied between the electrodes is low, and the display luminance is low when the voltage applied between the electrodes is high.

14. The method for driving an active matrix type display apparatus of claim 11, wherein the predetermined period of the period in which the switching elements are in the non-conducting state is within a range of 10% to 70% of the period in which the switching elements are selectively put into the conducting state in accordance with the scanning signal on the scanning lines.

15. The method for driving an active matrix type display apparatus of claim 11, wherein driving of the auxiliary capacitor lines is carried out such that an absolute value $|\Delta Vcs|$ of a total displacement potential $\Delta Vcs$ between the electrodes of the pixel capacitors which is produced through the auxiliary capacitors satisfies the condition $|\Delta Vcs| > Vc \times Cp/Ccs$, wherein Vc is an intermediate luminance display voltage applied to the pixel capacitors during display, Cp is a total capacitance of a pixel capacitor including a capacitance Ccs of the auxiliary capacitor.

16. The method for driving an active matrix type display apparatus of claim 11, wherein an overshooting voltage is applied at an initial stage when driving the auxiliary capacitor lines.

17. The method for driving an active matrix type display apparatus of claim 11, wherein the voltage is changed stepwise when driving the auxiliary capacitor lines.

18. The method for driving an active matrix type display apparatus of claim 12, wherein the pixel capacitors include a liquid crystal layer arranged between opposing electrodes, and display is performed in normally white display mode, such that the display luminance is high when the voltage applied between the electrodes is low, and the display luminance is low when the voltage applied between the electrodes is high.

19. The method for driving an active matrix type display apparatus of claim 12, wherein the predetermined period of the period in which the switching elements are in the non-conducting state is within a range of 10% to 70% of the period in which the switching elements are selectively put into the conducting state in accordance with the scanning signal on the scanning lines.

20. The method for driving an active matrix type display apparatus of claim 12, wherein driving of the auxiliary capacitor lines is carried out such that an absolute value $|\Delta Vcs|$ of a total displacement potential $\Delta Vcs$ between the electrodes of the pixel capacitors which is produced through the auxiliary capacitors satisfies the condition $|\Delta Vcs| > Vc \times Cp/Ccs$, wherein Vc is an intermediate luminance display voltage applied to the pixel capacitors during display, Cp is a total capacitance of a pixel capacitor including a capacitance Ccs of the auxiliary capacitor.

21. The method for driving an active matrix type display apparatus of claim 12, wherein an overshooting voltage is applied at an initial stage when driving the auxiliary capacitor lines.

22. The method for driving an active matrix type display apparatus of claim 12, wherein the voltage is changed stepwise when driving the auxiliary capacitor lines.

* * * * *